US011251524B1

(12) United States Patent
Smith

(10) Patent No.: US 11,251,524 B1
(45) **Date of Patent: *Feb. 15, 2022**

(54) PHASED-ARRAY ANTENNA SYSTEM

(71) Applicant: NORTHROP GRUMMAN SYSTEMS CORPORATION, Falls Church, VA (US)

(72) Inventor: Ronald P. Smith, Manhattan Beach, CA (US)

(73) Assignee: NORTHROP GRUMMAN SYSTEMS CORPORATION, Falls Church, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/021,717

(22) Filed: Sep. 15, 2020

Related U.S. Application Data

(63) Continuation of application No. 16/804,833, filed on Feb. 28, 2020, now Pat. No. 10,892,549.

(51) Int. Cl.
*H01Q 3/34* (2006.01)

(52) U.S. Cl.
CPC ..... *H01Q 3/34* (2013.01)

(58) Field of Classification Search
CPC ..... H01Q 3/34; H04B 7/0617
See application file for complete search history.

(56) References Cited

U.S. PATENT DOCUMENTS

| | | | |
|---|---|---|---|
| 2,980,909 | A | 4/1961 | Clanton, Jr. et al. |
| 3,026,516 | A | 3/1962 | Davis |
| 3,045,236 | A | 7/1962 | Colman et al. |
| 3,099,836 | A | 7/1963 | Carr |

(Continued)

FOREIGN PATENT DOCUMENTS

| | | | |
|---|---|---|---|
| CN | 101364672 | A | 4/2012 |
| EP | 1544963 | A1 | 6/2005 |

(Continued)

OTHER PUBLICATIONS

Final Office Action for U.S. Appl. No. 15/693,139 dated Feb. 23, 2021.

(Continued)

*Primary Examiner* — Freshteh N Aghdam
(74) *Attorney, Agent, or Firm* — Tarolli, Sundheim, Covell & Tummino LLP

(57) ABSTRACT

A phased-array antenna system includes antenna elements of an RF front-end that each propagate a wireless beam portion. A digital beamforming system generates a digital beam corresponding to the wireless beam that is transmitted or received from the phased-array antenna system. Digital beamforming processors are each associated with a proper subset of the antenna elements. The digital beamforming processors can be collectively configured to iteratively process digital beam portions of the digital beam in a plurality of iteration levels comprising a lowest iteration level associated with lowest-level digital beam portions corresponding to the respective wireless beam portions at each of the respective antenna elements and a highest iteration level associated with the digital beam. Each digital beam portion associated with a given iteration level includes a sum of lesser digital beam portions from a next lower iteration level.

20 Claims, 7 Drawing Sheets

(56) References Cited

U.S. PATENT DOCUMENTS 3,148,370 A 9/1964 Bowman
3,681,771 A 8/1972 Lewis et al.
3,852,765 A 12/1974 Bresler et al.
4,122,447 A 10/1978 Kawai et al.
4,658,258 A 4/1987 Wilson
4,797,682 A 1/1989 Klimczak
4,905,014 A 2/1990 Gonzalez et al.
5,049,891 A 9/1991 Ettinger et al.
5,087,896 A 2/1992 Wen et al.
5,155,050 A 10/1992 Bayraktaroglu
5,191,351 A 3/1993 Hofer et al.
5,220,330 A 6/1993 Salvail et al.
5,400,042 A 3/1995 Tulintseff
5,459,123 A 10/1995 Das
5,483,246 A 1/1996 Barnett et al.
5,552,797 A 9/1996 Cook
5,619,216 A 4/1997 Park
5,714,961 A 2/1998 Kot et al.
5,874,915 A 2/1999 Lee et al.
5,892,485 A 4/1999 Glabe et al.
5,923,229 A 7/1999 Simons
6,147,647 A 11/2000 Tassoudji et al.
6,163,304 A 12/2000 Peebles et al.
6,208,309 B1 3/2001 Chandler et al.
6,208,310 B1 3/2001 Suleiman et al.
6,278,407 B1 8/2001 Ashjaee et al.
6,356,240 B1 3/2002 Taylor
6,366,184 B1 4/2002 Ohtonen
6,400,337 B1 6/2002 Handelsman
6,426,727 B2 7/2002 Gilbert
6,473,053 B1 10/2002 Krishmar-Junker et al.
6,501,426 B2 12/2002 Waterman
6,504,514 B1 1/2003 Toland et al.
6,552,691 B2 4/2003 Mohuchy et al.
6,577,283 B2 6/2003 Wu et al.
6,639,461 B1 10/2003 Tam et al.
6,647,158 B2 11/2003 Betts et al.
6,657,516 B1 12/2003 Junker et al.
6,673,667 B2 1/2004 Gorrell et al.
6,737,936 B2 5/2004 Noguchi
6,999,034 B1 2/2006 Tsai et al.
7,034,774 B2 4/2006 Kuo et al.
7,154,451 B1 12/2006 Sievenpiper
7,180,457 B2 2/2007 Trott et al.
7,855,690 B2 12/2010 Hoeoek et al.
7,907,090 B2 3/2011 Bershadsky et al.
8,144,059 B2 3/2012 Lynch
8,217,847 B2 7/2012 Sotelo et al.
8,253,641 B1 8/2012 Waterman
8,294,631 B2 10/2012 Croston
8,319,688 B2 11/2012 Parsche
8,457,026 B1 * 6/2013 Ho ..... H04B 7/0617 370/310
8,508,319 B1 8/2013 Newsham et al.
8,665,040 B1 3/2014 Chappell et al.
8,736,505 B2 5/2014 Lambert et al.
10,027,005 B2 7/2018 Torpey et al.
10,256,545 B2 4/2019 Boryssenko et al.
10,547,118 B2 1/2020 Guntupalli et al.
10,892,549 B1 1/2021 Smith
10,944,164 B2 3/2021 Cooley et al.
11,075,456 B1 7/2021 Hennig et al.
2001/0050650 A1 12/2001 Gilbert
2001/0054978 A1 12/2001 Adachi et al.
2003/0020666 A1 1/2003 Wright
2003/0137456 A1 7/2003 Sreenivas et al.
2004/0004580 A1 1/2004 Toland et al.
2004/0046623 A1 3/2004 Brown et al.
2004/0164915 A1 8/2004 Quan et al.
2004/0222934 A1 11/2004 Wu
2004/0227596 A1 11/2004 Nguyen et al.
2005/0285808 A1 12/2005 Holter
2006/0006966 A1 1/2006 Kang et al.
2006/0038732 A1 2/2006 DeLuca et al.
2006/0232479 A1 10/2006 Walton
2007/0060046 A1 3/2007 Lee et al.
2007/0257858 A1 11/2007 Liu
2007/0287634 A1 12/2007 Lin et al.
2007/0296639 A1 12/2007 Hoeoek et al.
2008/0030416 A1 2/2008 Lee et al.
2008/0038732 A1 2/2008 Hah et al.
2008/0111757 A1 5/2008 Bisiules et al.
2008/0238790 A1 10/2008 McGrath et al.
2009/0079645 A1 3/2009 Sotelo et al.
2009/0091406 A1 4/2009 Kushta et al.
2009/0135076 A1 5/2009 Foo
2009/0243762 A1 10/2009 Chen et al.
2009/0303147 A1 12/2009 Choudhury
2010/0018301 A1 1/2010 Lutke et al.
2010/0054356 A1 * 3/2010 Keerthi ..... H04B 7/086 375/267
2010/0085272 A1 4/2010 Legay et al.
2010/0117903 A1 5/2010 Zheng
2010/0141551 A1 6/2010 Peng
2010/0178884 A1 * 7/2010 Nassiri-Toussi ..... H04B 7/0851 455/101
2010/0194629 A1 8/2010 Craig et al.
2010/0220036 A1 9/2010 Maruyama et al.
2011/0059688 A1 3/2011 Noonan et al.
2012/0280872 A1 11/2012 Werner et al.
2013/0182790 A1 7/2013 Jalali et al.
2013/0214972 A1 8/2013 Woodell et al.
2013/0214980 A1 8/2013 Lambert et al.
2013/0328635 A1 12/2013 Sekiguchi
2014/0159949 A1 6/2014 Mialhe
2014/0231266 A1 8/2014 Sherrer et al.
2014/0285394 A1 9/2014 Truthan
2015/0162663 A1 6/2015 Boryssenko et al.
2015/0162665 A1 6/2015 Boryssenko et al.
2016/0164155 A1 6/2016 Wang et al.
2016/0211585 A1 7/2016 Chau et al.
2017/0142605 A1 * 5/2017 Cheng ..... H04B 7/0617
2019/0013592 A1 1/2019 West et al.
2019/0020114 A1 1/2019 Paulotto et al.
2019/0165485 A1 5/2019 Hand et al.
2019/0260137 A1 8/2019 Watanabe et al.
2019/0279950 A1 9/2019 Kim et al.
2019/0319369 A1 10/2019 Chiang et al.
2020/0106158 A1 4/2020 Gomez Angulo et al.
2020/0106178 A1 4/2020 Chou
2020/0112081 A1 4/2020 Kim et al.
2020/0185826 A1 6/2020 Park et al.

FOREIGN PATENT DOCUMENTS

JP 2001036306 A 2/2001
WO 02/31908 A2 4/2002
WO 03098943 A1 11/2003
WO 2004093416 A1 10/2004
WO 2005/039074 A1 4/2005
WO 2009036305 A1 3/2009
WO 2012102576 A2 8/2012
WO 2014117259 A1 8/2014

OTHER PUBLICATIONS

International Search Report for Application No. PCT/US2020/059573 dated Feb. 22, 2021.
Final Office Action for U.S. Appl. No. 15/693,139 dated Sep. 9, 2020.
Israeli Office Action for Application No. 257201 dated Jun. 21, 2021.
Israeli Office Action for Application No. 257201 dated Apr. 21, 2021.

* cited by examiner

PHASED-ARRAY ANTENNA SYSTEM

GOVERNMENT INTEREST

The invention was made under Government Contract. Therefore, the U.S. Government has rights to the invention as specified in that contract.

RELATED APPLICATIONS

This application claims priority from U.S. patent application Ser. No. 16/804,833, filed 28 Feb. 2020, which is incorporated herein by reference in its entirety.

TECHNICAL FIELD

The present disclosure relates generally to communications, and specifically to a phased-array antenna system.

BACKGROUND

Modern wireless communications implement a variety of different physical arrangements for associated antennae for transmitting and receiving wireless beams. One example is arranged as a phased-array antenna that includes an array of antenna elements. Each of the antenna elements can be configured to propagate (e.g., transmit or receive) a portion of the wireless beam, with the portion of the wireless beam being associated with time delay and amplitude of the wireless beam to provide beam steering of the wireless beam. For a received wireless beam, the received wireless beam portions can be combined and processed to determine a resultant wireless beam that can be digitized and processed (e.g., to determine data modulated therein). For a transmitted wireless beam, a digital beam can be generated and can be decomposed into respective analog portions that are provided to the antenna elements at the respective time delay and amplitude for transmission of the wireless beam. The process of transitioning between the digital beam and the wireless beam portions is called beamforming, which is typically performed by a beamforming processor that is coupled to the antenna elements by a large fan-out of conductors.

SUMMARY

A phased-array antenna system includes antenna elements of an RF front-end that each propagate a wireless beam portion. A digital beamforming system generates a digital beam corresponding to the wireless beam that is transmitted or received from the phased-array antenna system. Digital beamforming processors are each associated with a proper subset of the antenna elements. The digital beamforming processors can be collectively configured to iteratively process digital beam portions of the digital beam in a plurality of iteration levels comprising a lowest iteration level associated with lowest-level digital beam portions corresponding to the respective wireless beam portions at each of the respective antenna elements and a highest iteration level associated with the digital beam. Each digital beam portion associated with a given iteration level includes a sum of lesser and relatively time-delayed digital beam portions from a next lower iteration level.

Another example includes a method for receiving a wireless beam via a phased-array antenna system. The method includes receiving a portion of the wireless beam at each of a plurality of antenna elements arranged in an array and associated with an RF front-end. The method also includes converting the portion of the wireless beam associated with each of the antenna elements to a respective lowest-level digital beam portion via a respective plurality of analog-to-digital converters (ADC). The method also includes adding the lowest-level digital beam portion associated with each of a plurality of proper subsets of the antenna elements via each of a plurality of digital beamforming processors to generate a plurality of digital beam portions at a lowest iteration level of an iterative processing of the wireless beam. The method also includes iteratively adding the digital beam portions via the digital beamforming processors in a plurality of iteration levels comprising the lowest iteration level and a highest iteration level. Each digital beam portion associated with a given iteration level includes a sum of lesser and relatively time-delayed digital beam portions from a next lower iteration level of the iterative processing. The method further includes adding the digital beam portions associated with the highest iteration level to generate a digital beam corresponding to the wireless beam.

Another example includes a method for transmitting a wireless beam via a phased-array antenna system. The method includes generating a digital beam corresponding to a wireless beam to be transmitted from the phased-array antenna system. The method includes distributing digital beam portions from the digital beam at a highest iteration level of a plurality of iteration levels of an iterative processing of the digital beam via a plurality of digital beamforming processors. The method also includes iteratively distributing the digital beam portions via the digital beamforming processors in a plurality of iteration levels comprising the highest iteration level and a lowest iteration level. Each digital beam portion associated with a given iteration level is distributed from the given iteration level as a plurality of lesser digital beam portions with relatively different time-delays to a next lower iteration level of the iterative processing with the lesser digital beam portions being equal in aggregate to the respective digital beam portion. The method also includes distributing a plurality of digital beam portions to generate a plurality of lowest-level digital beam portions associated with each of a plurality of antenna elements via each of the plurality of digital beamforming processors the lowest iteration level of the iterative processing of the digital beam. The method further includes converting the lowest-level digital beam portions to wireless beam portions associated with each of the respective antenna elements via a respective plurality of digital-to-analog converters (DAC), and transmitting the wireless beam portions from each of the respective plurality of antenna elements as the wireless beam.

DETAILED DESCRIPTION

Figure 1:
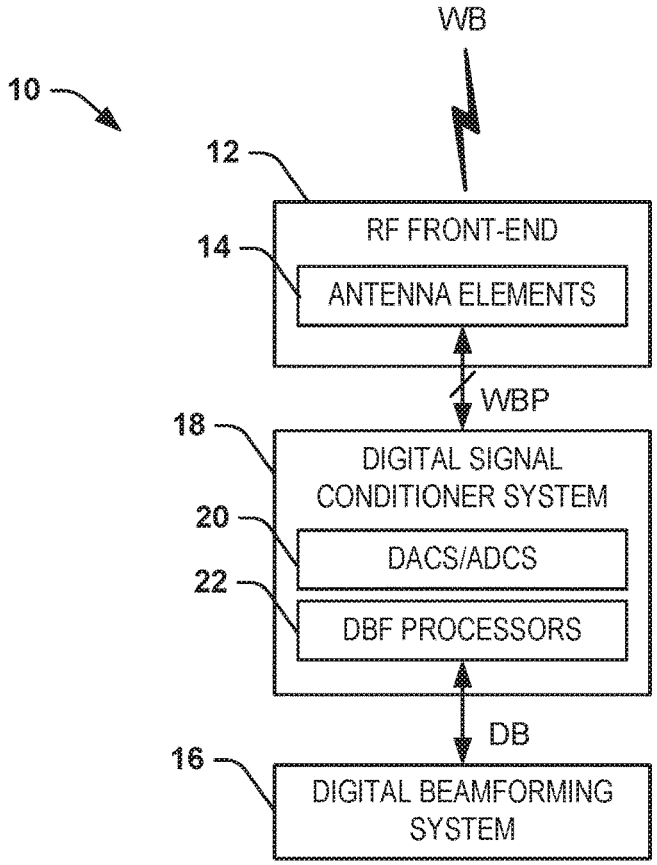
FIG. 1 illustrates an example diagram of a phased-array antenna system.

The present disclosure relates generally to communications, and specifically to a phased-array antenna system. The phased-array antenna system can be implemented in any of a variety of communications applications that implement beam steering or multi-directional signal receipt. The phased-array antenna system includes a radio frequency (RF) front-end that includes an array of antenna elements that can each be configured to propagate a wireless beam portion. As described herein, the term "propagate" with respect to the wireless beam and to wireless beam portions is intended to refer to either signal transmission or receipt, such that the phased-array antenna system can both transmit and receive wireless beams. The wireless beam portions can thus have different phase and/or amplitude components that can correspond to beamforming of the wireless beam, such as for transmitting the wireless beam in a predetermined direction from the phased-array antenna system or for processing a source from which the wireless beam was received by the phased-array antenna system.

The phased-array antenna system also includes a digital beamforming system that is configured to generate a digital beam. As an example, the digital beam can include modulated data therein. The digital beam can correspond to the wireless beam that is transmitted from or received at the RF front-end, and can be generated to have the corresponding time delay and amplitude components that can be associated with the beamforming of the wireless beam. The phased-array antenna system also includes a digital signal conditioner system that is configured to provide signal conditioning and analog/digital conversion of the respective digital beam/wireless beam. For example, the signal conditioning can include tuning, filtering, decimation, and/or time-alignment of portions of the digital beam, and can also include analog-to-digital converters (ADCs) to convert a received analog wireless beam to the digital beam and digital-to-analog converters (DACs) to convert the digital beam to the analog wireless beam for transmission.

In addition, the digital beamforming system includes a plurality of digital beamforming processors. The digital beamforming processors can be distributed across the array of antenna elements, such that each of the digital beamforming processors can be associated with a proper subset of the antenna elements. Therefore, each of the digital beamforming processors can be communicatively coupled to a portion of the antenna elements to process a lowest-level digital beam portion associated with each of the corresponding antenna elements in the proper subset. As described herein, the term "process" refers to additive combination (e.g., for a received wireless beam) or distribution (e.g., for a transmitted wireless beam) of digital beam portions of the digital beam at each of a plurality of iteration levels, between the lowest-level digital beam portions associated with each of the respective antenna elements and the digital beam that is an aggregate of all of the lowest-level digital beam portions. At each iteration level, time-delay information can be applied to the respective digital beam portion for each of the iterative groups of antenna elements to perform iterative beamforming.

For example, as described in greater detail herein, the application of time-delay in the receive direction is related to time-delaying a given lower-iteration level digital beam portion to be time-aligned to at least one of the other lower-iteration level digital beam portions (e.g., to the digital beam portion most delayed in arrival based on the beam direction of the received wireless beam) that form a given next higher-iteration level digital beam portion. As a result, for example, the digital beam portion of a set of digital beam portions that is most time-delayed corresponds to the portions of the antenna array that are closest in direction to a source from which the received wireless beam was transmitted. Similarly, as also described in greater detail herein, the application of time-delay in the transmit direction is related to separately time-delaying each lower-iteration level digital beam portion relative to each other. As a result, for example, the digital beam portion of a set of digital beam portions that is most time-delayed corresponds to the portions of the antenna array that are closest in direction to a direction to which the wireless beam is to be transmitted. As another example, time-delays associated with the lowest-level digital beam portions at the antenna element level can be accomplished with phase-shifts of the digital or analog signals associated with the antenna elements relative to each other, such as to approximate a time-delay over a limited frequency range. Additionally, while the examples of applying time-delay above can correspond to processing a flat plane wave at the digital beamforming system, it is to be understood that the time-delays of digital beam portions can be provided in a variety of different ways for the purpose of beamforming. While a relative time-delay is described herein throughout, it is also to be understood that amplitude information can also be applied to each of the digital beam portions in each of the iteration levels. As described herein, the term "distribute" and forms thereof refer to portioning a given digital beam portion associated with a given iteration level from a digital beamforming processor as multiple digital beam portions to respective different digital beamforming processors.

As described in greater detail herein, the digital beamforming processors can collectively iteratively process the digital beam portions of the digital beam in a plurality of iteration levels. The iteration levels can include a lowest iteration level associated with the lowest-level digital beam portions associated with each of the respective antenna elements, can include a highest iteration level associated with the digital beam itself, and can include at least one iteration level therebetween. Each digital beam portion associated with a given iteration level can therefore include a sum of lesser digital beam portions from a next lower iteration level. By providing the iterative processing of the digital beam portions associated with the digital beam, the phased-array antenna system can therefore more efficiently provide beamforming for the digital beam, as opposed to distributing the beamforming component signals to one processor from each individual antenna element.

FIG. 1 illustrates an example diagram of a phased-array antenna system 10. The phased-array antenna system 10 can be implemented in any of a variety of communications applications that implement beam steering or multi-directional signal receipt.

In the example of FIG. 1, the phased-array antenna system 10 includes a radio frequency (RF) front-end 12 that includes a plurality of antenna elements 14 that are arranged in an array. Each of the antenna elements 14 can be configured to propagate a wireless beam portion. In the example of FIG. 1, the wireless beam is demonstrated as a wireless signal "WB", whereas the wireless beam portions are demonstrated as a set of signals WBP. As an example, the phased-array antenna system 10 can be bidirectional, such that the wireless beam WB can be received by the phased-array antenna system 10 or transmitted from the phased-array antenna system 10. The wireless beam portions WBP can thus have different phase and/or amplitude components that can correspond to beamforming of the wireless beam WB, such as for transmitting the wireless beam WB in a predetermined direction from the phased-array antenna system 10 or for pointing the phased-array antenna system 10 toward the source of transmission of the wireless beam WB received by the phased-array antenna system 10.

The phased-array antenna system 10 also includes a digital beamforming system 16 that is configured to generate a digital beam, demonstrated in the example of FIG. 1 as a signal DB. As an example, the digital beam DB can include modulated data therein, such as communications data, radar data, or any other type of baseband data that can be modulated onto a higher frequency carrier. The digital beam DB can correspond to the wireless beam WB that is transmitted from or received at the RF front-end 12, and can be generated to have the corresponding time delay and amplitude components, as provided on the wireless beam portions WBP, that can be associated with the beamforming of the wireless beam WB.

The phased-array antenna system 10 also includes a digital signal conditioner system 18 that is configured to provide signal conditioning and analog/digital conversion between the respective digital beam DB and the wireless beam WB. In the example of FIG. 1, the digital signal conditioner system 18 includes a set of analog-to-digital converters (ADCs) to convert the analog wireless beam WB to the digital beam DB and digital-to-analog converters (DACs) to convert the digital beam DB to the analog wireless beam WB for transmission, demonstrated collectively as "DACS/ADCS" 20. In addition, the digital signal conditioner system 18 can include a variety of other signal conditioning components that can provide tuning, filtering, decimation, and/or time-alignment of lowest-level digital beam portions (referred to hereafter as "lowest-level digital beam portions LDBP") that can correspond to the decimated portions of the digital beam DB.

In addition, the digital signal conditioner system 18 includes a plurality of digital beamforming processors ("DBF PROCESSORS") 22. For example, the digital beamforming processors 22 can be configured as any of a variety of processing devices, such as processors, application specific integrated circuit (ASICs), field-programmable gate arrays (FPGAs), or other types of processing devices. The digital beamforming processors 22 can be distributed in an array across the array of antenna elements 14, such that each of the digital beamforming processors 22 can be associated with a proper subset of the antenna elements 14. Therefore, each of the digital beamforming processors 22 can be communicatively coupled to a portion of the antenna elements 14 to process a respective lowest-level digital beam portion associated with each of the corresponding antenna elements 14 in the proper subset. As described in greater detail herein, the digital beamforming processors 22 can collectively iteratively process digital beam portions of the digital beam DB in a plurality of iteration levels. The iteration levels can include a lowest iteration level associated with the lowest-level digital beam portions corresponding to each of the respective antenna elements 14, can include a highest iteration level associated with the digital beam DB, and can include at least one iteration level therebetween.

Each digital beam portion associated with a given iteration level can include an aggregate of lesser digital beam portions from a next lower iteration level. For example, each digital beam portion is associated with a plurality of lowest-level digital beam portions corresponding to a subset of the antenna elements 14. Therefore, the digital beam portion associated with a given iteration level includes a subset of the antenna elements 14 that is greater than the subset of the antenna elements 14 associated with the next lower iteration level of the iterative processing. Additionally, at each iteration level, the digital beamforming processors 22 can add or apply time-delay information to the respective digital beam portion for each of the successive iterative groups of antenna elements 14 to perform iterative beamforming. Such iterative application of time-delay in each of the iteration levels provides for efficient processing by the digital beamforming processors based on the time-delay being relatively very close in value for physically proximal antenna elements 14, as opposed to time-delay values for relatively distal antenna elements 14. In other words, for any given beam direction, the required amount of time-delay for the digital beamforming is similar for the antenna elements 14 that are physically close to each other, while the delay difference is the greatest for antenna elements 14 that are physically far apart. By providing the iterative processing of the digital beam portions associated with the digital beam DB, the phased-array antenna system 10 can therefore more efficiently provide beamforming for the digital beam DB, as opposed to distributing the beamforming component signals from one processor to each individual antenna element 14.

Furthermore, the digital signal conditioner system 18 can include a plurality of separate frequency channels that are each associated with a separate respective frequency. Each of the frequency channels can be coupled to each of the plurality of digital beamforming processors 22, such that the iterative beamforming described herein can be concurrently implemented on multiple different signals each having a separate respective frequency. For example, the digital beam portions DBP from the highest iteration level or the lowest-level digital beam portions LDBP from the lowest iteration level can be frequency converted to different frequency bands, and a different time-delay can be applied for each antenna element 14. Additionally or alternatively, the phased-array antenna system 10 can be configured to concurrently process multiple wireless beams WB having similar or the same frequency bands that can be provided towards or received from different directions based on the wireless beam portions WBP having different time delay and/or amplitude components for each antenna element 14. For example, the different signals may be at the same or different frequency bands, and the separate wireless beams WB can be distributed to each of the respective antenna elements 14, at which each resultant wireless beam portion WBP can have a different delay at any one antenna element 14. The delayed wireless beam portions WBP for the separate wireless beams WB can be summed prior to being output through each respective one antenna element 14, with different delays for the separate respective wireless beam portions WBP of the separate respective wireless beams WB. Furthermore, the phased-array antenna system 10 can be configured to iteratively process the digital beam portions for both transmitted and received wireless beams, respectively, in a concurrent manner based on the conductive connections between the digital beamforming processors 22, as described in greater detail herein.

Figure 2:
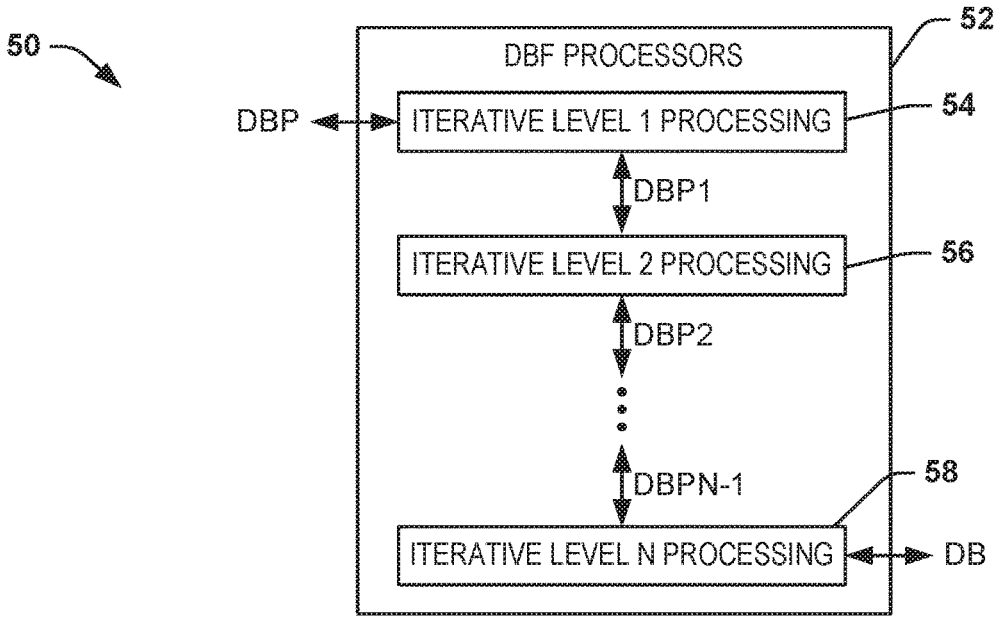
FIG. 2 illustrates an example diagram of digital beamformer processors.

FIG. 2 illustrates an example diagram 50 of digital beam-former processors, demonstrated diagrammatically at 52. The diagram 50 is demonstrated to provide a visual description of the iterative processing of the digital beam DB in the structure of iteration levels. As an example, the digital beamforming processors 52 can correspond to the digital beamforming processors 22 in the example of FIG. 1. Therefore, reference is to be made to the example of FIG. 1 in the following description of the example of FIG. 2.

The diagram 50 demonstrates a plurality N of iteration levels of iterative processing, where N is a positive integer greater than or equal to two. The iteration levels include a first iteration level 54, demonstrated as "LEVEL 1 ARRAY PROCESSING", a second iteration level 56, demonstrated as "LEVEL 2 ARRAY PROCESSING", and an Nth iteration level 58, demonstrated as "LEVEL N ARRAY PROCESSING". It is to be understood that the digital beamforming processors 52 can implement additional iteration levels between the second iteration level 56 and the Nth iteration level 58. In the example of FIG. 2, the iteration levels 54, 56, and 58 are arranged between the digital beam DB that is provided to and from the Nth iteration level 58 and a plurality of lowest-level digital beam portions LDBP that are provided to and from the first iteration level 54.

As an example, for a received wireless beam WB, each of the antenna elements 14 can provide a respective wireless beam portion that is associated with the amplitude and relative time-delay of the respective wireless beam WB. The wireless beam portions can each be digitized (e.g., via the ADCs 20 associated with the digital signal conditioner system 18) to generate lowest-level digital beam portions LDBP that are digital equivalents of the wireless beam portions. The digital beamforming processors 52 can thus apply a respective time-delay between the lowest-level digital beam portions LDBP of a given set of antenna elements 14 and add each of the lowest-level digital beam portions LDBP of the plurality of sets of lowest-level digital beam portions LDBP in the first iteration level 54 to generate first iteration level digital beam portions DBP1. As an example, a relative time-delay can be assigned to each of the first iteration level digital beam portions DBP1, such as corresponding to a lowest time-delay of the individual antenna elements 14 of the set of antenna elements 14 associated with the respective first iteration level digital beam portion DBP1. Each of the first iteration level digital beam portions DBP1 can correspond to a sum of the lowest-level digital beam portions LDBP associated with a given proper subset of the antenna elements 14. For example, each of the digital beamforming processors 52 is configured to generate a respective first iteration level digital beam portion DBP1. As another example, each of the proper subsets of the antenna elements 14 can be approximately equal with respect to a quantity of antenna elements 14.

In the example of FIG. 2, the digital beamforming processors 52 can apply a respective time-delay between the first iteration level digital beam portions DBP1 of the relatively larger set of antenna elements 14 and can add the first iteration level digital beam portions DBP1 in the second iteration level 56 to generate second iteration level digital beam portions DBP2. As an example, a relative time-delay can be assigned to each of the second iteration level digital beam portions DBP2, such as corresponding to a lowest time-delay of the first iteration level digital beam portions DBP1 of the set of antenna elements 14 associated with the respective second iteration level digital beam portion DBP2.

As another example, the time-delay between the first iteration level digital beam portions DBP1 can be applied by the next higher iteration level of the digital beamforming processors 52 to implement the beamforming of the received wireless beam WB. For example, each of the second iteration level digital beam portions DBP2 can include a sum of a set of first iteration level digital beam portions DBP1 in the second iteration level 56, such that the quantity of second iteration level digital beam portions DBP2 is less than the quantity of first iteration level digital beam portions DBP1. Therefore, each of the second iteration level digital beam portions DBP2 corresponds to a sum of lowest-level digital beam portions LDBP from a quantity of antenna elements 14 that is greater than the quantity of antenna elements 14 associated with each of the first iteration level digital beam portions DBP2. As an example, a proper subset of the digital beamforming processors 52 can be configured to generate a respective one of the second iteration level digital beam portions DBP2.

The digital beamforming processors 52 can thus continue to iteratively apply respective time-delays to digital beam portions DBPX and add successive digital beam portions DBPX, where X corresponds to a given iteration level. For example, a different set of the digital beamforming processors 52 can be configured to add the digital beam portions DBPX from a given iteration level relative to the other iteration levels, such that a given one of the digital beamforming processors 52 does not generate digital beam portions DBP from more than two separate iteration levels (e.g., the first iteration level 54 and one other iteration level). In the example of FIG. 2, the Nth iteration level 58 receives digital beam portions DBPN-1 from the N-1 iteration level and adds the digital beam portions DBPN-1 to generate the digital beam DB. For example, the digital beam DB can thus correspond to a sum of the lowest-level digital beam portions LDBP of each of the antenna elements 14 of the RF front-end 12, and therefore can correspond to the wireless beam WB. As an example, the digital beam DB can be generated by a single one of the digital beamforming processors 52 in response to adding the digital beam portions DBPN-1.

The digital beam DB can be provided to the digital beamforming system 16 to process the digital beam DB corresponding to the wireless beam WB. For example, the digital beamforming system 16 can process the data associated with the digital beam DB to provide the time delay and amplitude information associated with the wireless beam portions WBP associated with each of the antenna elements 14. Therefore, the beamforming information associated with the digital beam DB, as determined by the digital beamforming system 16 can facilitate demodulation of the data in the digital beam DB, such as in the receive direction for signal detection, signal characterization, radar image processing, and/or other receiver applications. Additionally, as described previously, the digital beam portions at each of the iteration levels can correspond to beamforming of multiple digital beams DB each having a separate respective frequency, such as for concurrent transmission, reception, or a combination of transmission and reception of multiple respective wireless beams.

As an example, the iterative processing of the digital beamforming processors 52 can be substantially reversed for transmitting the wireless beam WB. For example, the digital beamforming system 16 can generate the digital beam DB based on desired beamforming characteristics associated with a desired direction of wireless beam WB to be transmitted. The digital beam DB can therefore be provided to one of the digital beamforming processors 52 that is configured to distribute the digital beam portions DBPN-1 from the digital beam DB in the Nth iteration level 58. For example, the digital beamforming processors 52 can distribute the digital beam portions DBPN-1 and can apply relatively different time delays to each of the digital beam portions DBPX in each of the successive iteration levels for steering the wireless beam WB in a desired direction. In the example of transmission of multiple wireless beams WB from the phased-array antenna system 10, the digital beamforming processors 52 can receive the digital beam portions DBPN-1 for each of multiple digital beams DB for different transmission directions, apply multiple time delays associated with the different directions and different antenna elements 14, and sum the time-delayed wireless beam portions WBP that ultimately are provided to a particular antenna element 14.

Each of the digital beam portions DBPN-1 are provided to a separate one of the digital beamforming processors 52 to implement processing in the N-1 iteration layer. The digital beamforming processors 52 can thus continue to iteratively distribute successive digital beam portions DBPX with a different set of the digital beamforming processors 52 for distributing the digital beam portions DBPX from a given iteration level relative to the other iteration levels. For example, at each successive iteration level, the digital beamforming processors 52 can apply a different relative time-delay to each of the different digital beam portions DBPX, such as a lowest time-delay associated with a given one of the antenna elements 14 relative to the other antenna elements 14 in the respective corresponding sets of antenna elements 14 of the respective digital beam portions DBPX. At the first iteration level 54, the respective lowest-level digital beam portions LDBP can be distributed from each of the digital beam portions DBP1 by each of the respective digital beamforming processors 52, with each of the lowest-level digital beam portions LDBP having a respective relative time-delay for transmission of the respective corresponding wireless beam portions WBP. The lowest-level digital beam portions LDBP can be converted to the analog wireless beam portions (e.g., by the DACs 20 in the example of FIG. 1), such that each of the wireless beam portions WBP can be transmitted from each of the antenna elements 14. As another example, the digital baseband data associated with the lowest-level digital beam portions LDBP may be a stream of numbers that is to be modulated (e.g., before or after the associated DAC) for a communications link, or it can be a waveform at a low frequency (e.g., a complex digital representation centered at approximately zero Hz, or a real digital representation at a positive frequency above approximately zero Hz), which can be translated to a higher frequency for transmission (e.g., in analog, digital, or a combination of analog and digital). As a result, the collective transmission of the wireless beam portions WBP from the respective antenna elements 14 can result in the transmission of the wireless beam WB based on the desired beamforming characteristics of the generated digital beam DB.

The iterative level processing between the digital beam DB and the lowest-level digital beam portions LDBP, as described in the example of FIG. 2, can be further described with reference to the examples of FIGS. 3-7. FIGS. 3-7 illustrate example diagrams of antenna elements of an RF front-end. The RF front-end in the examples of FIGS. 3-7 can correspond to the RF front-end 12 in the example of FIG. 1. Therefore, reference is to be made to the example of FIGS. 1 and 2 in the following description of the examples of FIGS. 3-7.

Figure 3:
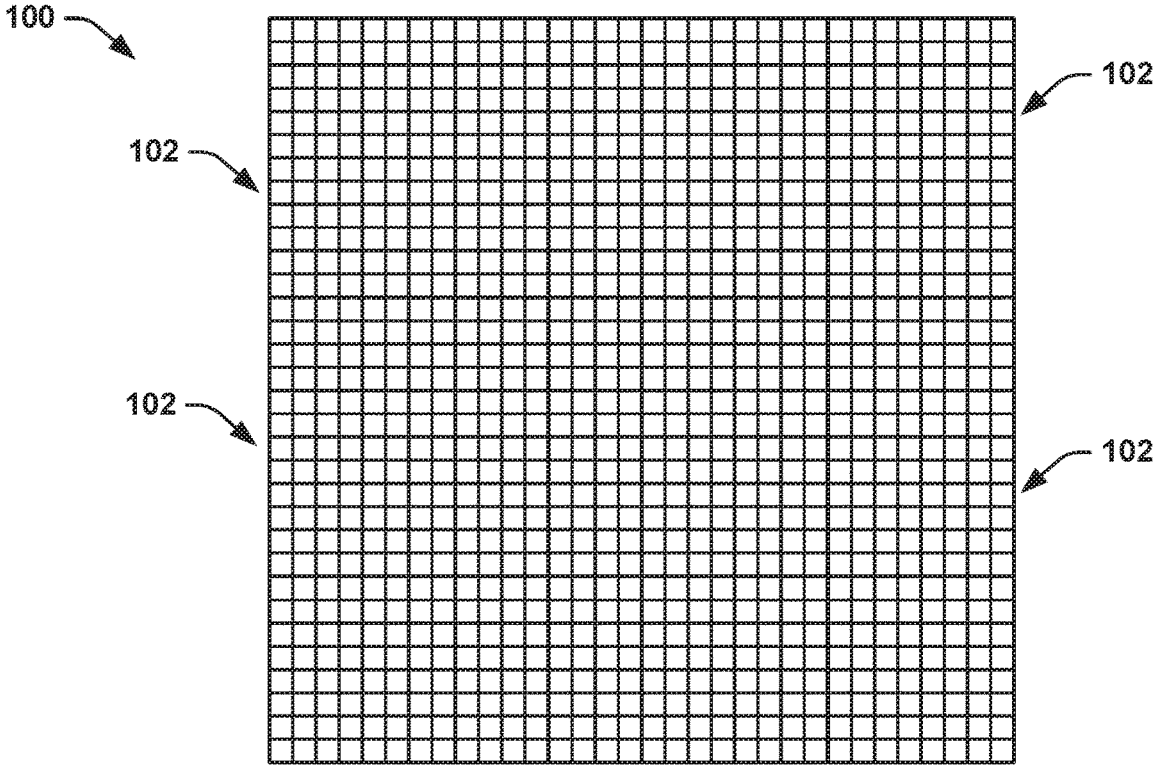
FIG. 3 illustrates an example diagram of antenna elements of an RF front-end.

The example of FIG. 3 demonstrates a diagram 100 of an array of antenna elements 102. As an example, the array of antenna elements 102 can correspond to the antenna elements 14 in the RF front-end 12. Each of the antenna elements 102 can be configured to propagate a respective one of the wireless beam portions WBP, with the wireless beam portions WBP collectively corresponding to the wireless beam WB. As an example, the antenna elements 102 can be bidirectional to transmit or receive the wireless beam WB, and thus to transmit or receive the respective wireless beam portions WBP on the respective antenna elements 102. In the example of FIG. 3, the diagram 100 demonstrates an array of 1024 antenna elements in a square array of thirty-two columns and thirty-two rows. However, it is to be understood that the array of antenna elements 102 is not limited to the quantity of antenna elements 102 in the diagram 100, and is further not limited to the square geometry of an equal number of rows and columns. As described herein, each of the antenna elements 102 can have a relative time-delay associated with it that corresponds collectively to a transmitted or received wireless beam WBP.

Figure 4:
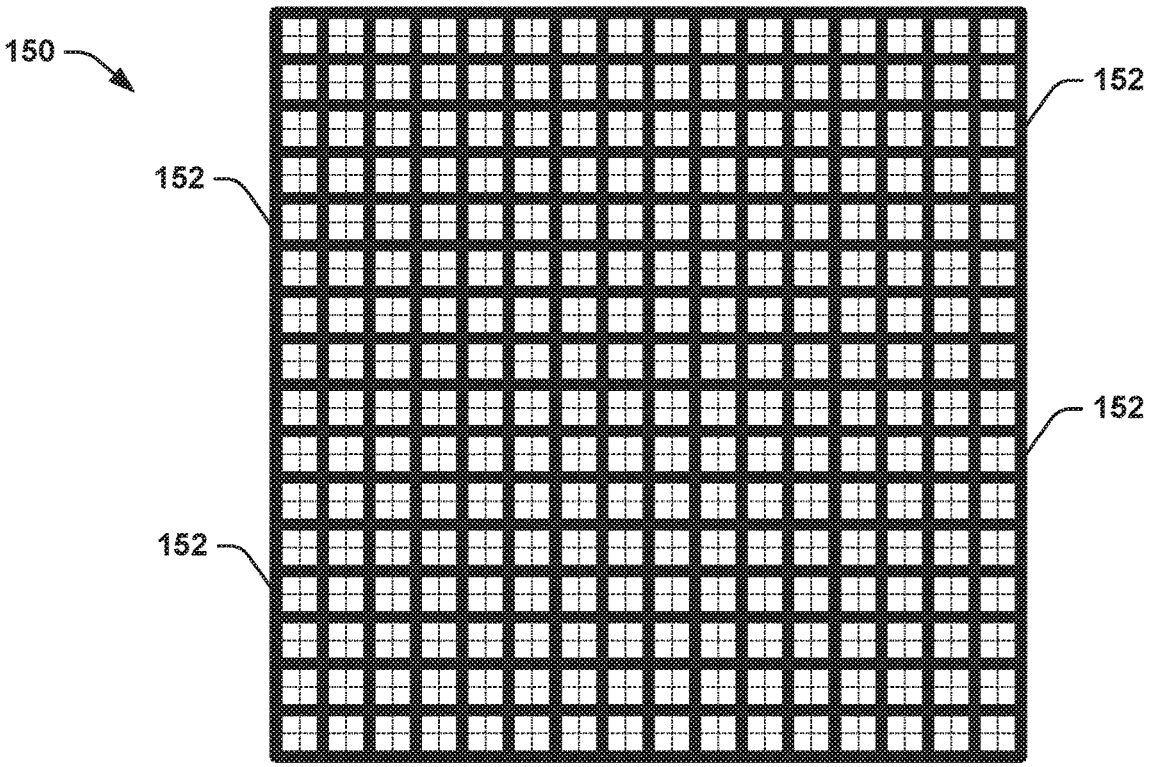
FIG. 4 illustrates another example diagram of antenna elements of an RF front-end.

The example of FIG. 4 demonstrates a diagram 150 of the array of antenna elements 102. As an example, the diagram 150 can correspond to a lowest iteration level of the iterative processing (e.g., the first iteration level 54 in the example of FIG. 2). In the example of FIG. 4, the antenna elements 102 are organized into proper subsets 152, where each proper subset 152 includes four antenna elements 102. Therefore, in the example of FIG. 4, the RF front-end includes 256 proper subsets 152 of antenna elements 102. As an example, each of the proper subsets 152 can correspond to a single respective digital beamforming processor, such that the associated phased-array antenna system can include 256 digital beamforming processors collectively configured to perform the iterative processing of the digital beam DB. As an example, the digital beamforming processors can be distributed in an array across the array of the antenna elements 102 to substantially minimize the conductive coupling of the digital beamforming processors to the respective antenna elements 102. As another example, the digital beamforming processors can be communicatively coupled to each other, such as based on each digital beamforming processor being communicatively coupled to proximal digital beamforming processors to pass digital beam portions to each other for performing the iterative processing, as described in greater detail herein.

In the example of receiving the wireless beam WB, in the lowest iteration level of the example of FIG. 4, each of the wireless beam portions WBP can be digitized (e.g., via the ADCs 20, which could be included in the digital beamforming processors 52) to generate lowest-level digital beam portions LDBP that are digital equivalents of the wireless beam portions WBP. Each of the digital beamforming processors 52 can thus add the lowest-level digital beam portions LDBP from each of the respective antenna elements 102 in a given one of the proper subsets 152 to generate a respective first iteration level digital beam portion DBP1. Therefore, each of the first iteration level digital beam portions DBP1 can correspond to a sum of four lowest-level digital beam portions LDBP associated with the respective four antenna elements 102 in a given one of the proper subsets 152. Additionally, relative time-delays between each of the lowest-level digital beam portions LDBP in a given proper subset 152 can be applied (e.g., prior to adding the lowest-level digital beam portions LDBP, as described previously), and the first iteration level digital beam portion DBP1 associated with a given proper subset 152 can be assigned an associated time-delay relative to the first iteration level digital beam portions DBP1 associated with other proper subsets 152, with the associated time-delay corresponding to a highest value time-delay associated with a given one of the antenna elements 102 in the respective proper subset 152 (e.g., corresponding to a last received wireless beam portion WBP in the respective proper subset 152).

Similarly, in the example of transmitting the wireless beam WB, in the lowest iteration level of the example of FIG. 4, each of the digital beamforming processors 52 can thus distribute four lowest-level digital beam portions LDBP from the first iteration level digital beam portion DBP1 in a given one of the proper subsets 152, such that each of the four lowest-level digital beam portions LDBP corresponds to a respective one of the four antenna elements 102 in the respective proper subset 152. Each of the lowest-level digital beam portions LDBP can be converted to analog (e.g., via the DACs 20, which could be included in the digital beamforming processors 52) to generate the wireless beam portions WBP that are to be transmitted from the respective individual antenna elements 102 as the wireless beam WB. Additionally, each of the lowest-level digital beam portions LDBP in a given one of the proper subsets 152 can be assigned a respective time-delay that is relative to each other for time-staggered transmission of the wireless beam portions WBP corresponding to beam-steering of the wireless beam WB.

Figure 5:
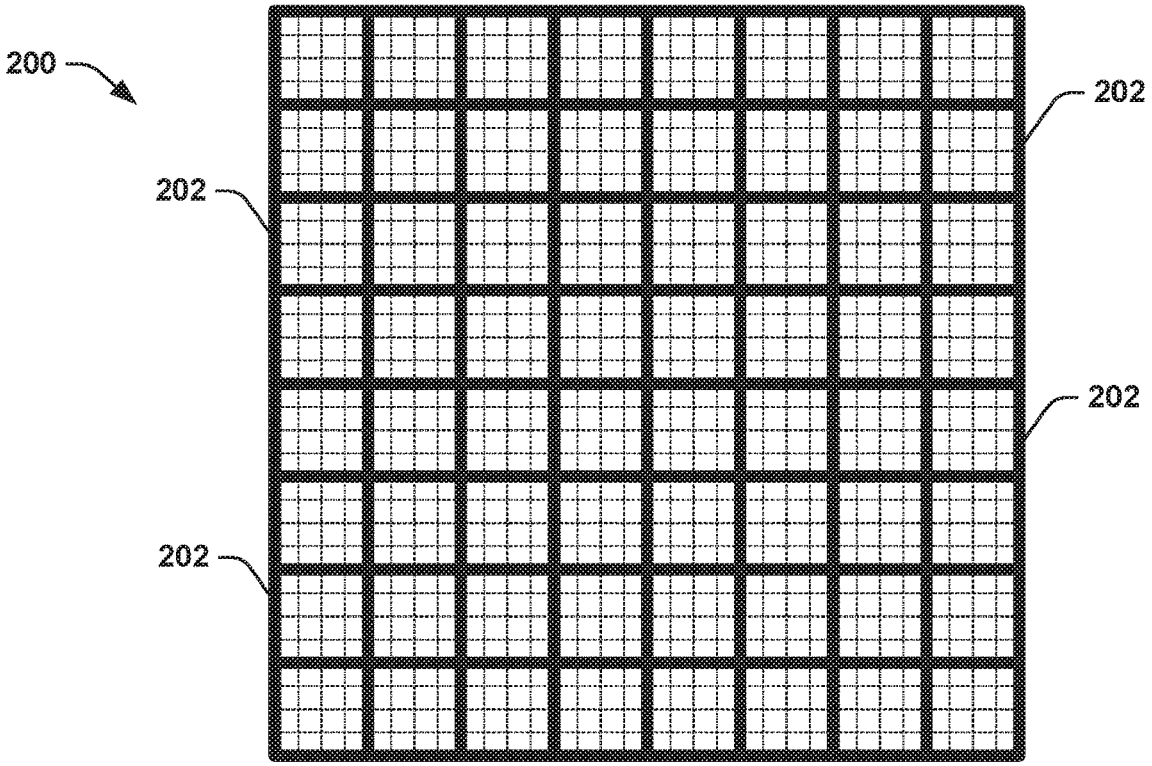
FIG. 5 illustrates another example diagram of antenna elements of an RF front-end.

The example of FIG. 5 demonstrates a diagram 200 of the array of antenna elements 102. As an example, the diagram 200 can correspond to a second iteration level of the iterative processing (e.g., the second iteration level 56 in the example of FIG. 2). In the example of FIG. 5, the antenna elements 102 are organized into proper subsets 202, where each proper subset 202 includes four of the proper subsets 152 in the example of FIG. 4. Therefore, each of the proper subsets 202 includes sixteen antenna elements 102. Therefore, in the example of FIG. 5, the RF front-end includes 64 proper subsets 202 of antenna elements 102.

In the example of receiving the wireless beam WB, in the second iteration level of the example of FIG. 5, one of the digital beamforming processors 52 can be associated with each of the proper subsets 202. Therefore, some of the digital beamforming processors 52 can each transmit a respective first iteration level digital beam portion DBP1 to another one of the digital beamforming processors 52 for the other one of the digital beamforming processors 52 to add the first iteration level digital beam portions DBP1 to generate a second iteration level digital beam portion DBP2 that is a sum of the first iteration level digital beam portions DBP1 provided to it. For example, because the second iteration level in the example of FIG. 5 demonstrates that each of the proper subsets 202 includes four of the proper subsets 152 in the example of FIG. 4, three digital beamforming processors 52 associated with a respective three of the proper subsets 152 can provide the respective first iteration level digital beam portions DBP1 to a fourth digital beamforming processor 52, and the fourth digital beamforming processor 52 can add the four first iteration level digital beam portions DBP1 (e.g., the three first iteration level digital beam portions DBP1 provided to the fourth digital beamforming processor 52 as well as the first iteration level digital beam portion DBP1 generated by the respective fourth digital beamforming processor 52) to generate the second iteration level digital beam portion DBP2. Therefore, the second iteration level digital beam portion DBP2 can correspond to a sum of the lowest-level digital beam portions LDBP of each of the respective sixteen antenna elements 102 in the respective proper subset 202. Additionally, relative time-delays between each of the first iteration level digital beam portions DBP1 in a given proper subset 202 can be applied, and the second iteration level digital beam portion DBP2 associated with a given proper subset 202 can be assigned an associated time-delay relative to the second iteration level digital beam portions DBP2 associated with other proper subsets 202, with the associated time-delay corresponding to a highest value time-delay associated with a given one of the antenna elements 102 in the respective proper subset 202.

Similarly, in the example of transmitting the wireless beam WB, in the second iteration level of the example of FIG. 5, a group of the digital beamforming processors 52 can each distribute four first iteration level digital beam portions DBP1 from a respective second iteration level digital beam portion DBP2 in a given one of the proper subsets 202, such that each of the four first iteration level digital beam portions DBP1 corresponds to a respective one of the proper subsets 152 in the example of FIG. 4. Additionally, each of the first iteration level digital beam portions DBP1 in a given one of the proper subsets 202 can be assigned a respective time-delay that is relative to each other for beam-steering the wireless beam WB to be transmitted from the array of antenna elements 102.

Figure 6:
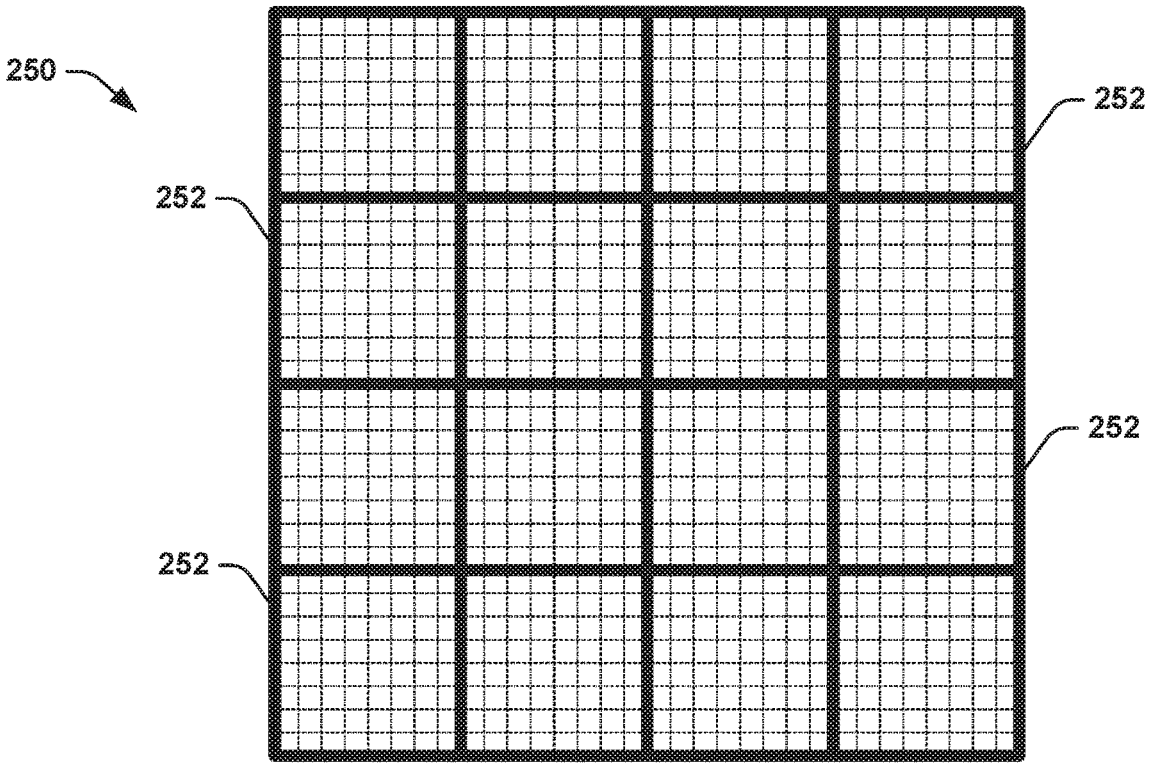
FIG. 6 illustrates another example diagram of antenna elements of an RF front-end.

The example of FIG. 6 demonstrates a diagram 250 of the array of antenna elements 102. As an example, the diagram 250 can correspond to a third iteration level of the iterative processing. In the example of FIG. 6, the antenna elements 102 are organized into proper subsets 252, where each proper subset 252 includes four of the proper subsets 202 in the example of FIG. 5. Therefore, each of the proper subsets 252 includes 64 antenna elements 102. Therefore, in the example of FIG. 6, the RF front-end includes sixteen proper subsets 252 of antenna elements 102.

In the example of receiving the wireless beam WB, in the third iteration level of the example of FIG. 6, one of the digital beamforming processors 52 can be associated with each respective one of the proper subsets 252. For example, the digital beamforming processors 52 that are each associated with one of the proper subsets 252 can be a different digital beamforming processor 52 than is associated with a proper subset of any other iteration level. Therefore, some of the digital beamforming processors 52 can each transmit a respective second iteration level digital beam portion DBP2 to another one of the digital beamforming processors 52 for the other one of the digital beamforming processors 52 to add the second iteration level digital beam portions DBP2 to generate a third iteration level digital beam portion DBP3 that is a sum of the second iteration level digital beam portions DBP2 provided to it. For example, because the third iteration level in the example of FIG. 6 demonstrates that each of the proper subsets 252 includes four of the proper subsets 202 in the example of FIG. 5, four digital beamforming processors 52 associated with a respective four of the proper subsets 202 can provide the respective second iteration level digital beam portions DBP2 to a fifth digital beamforming processor 52, and the fifth digital beamforming processor 52 can add the four second iteration level digital beam portions DBP2 to generate the third iteration level digital beam portion DBP3. Therefore, the third iteration level digital beam portion DBP3 can correspond to a sum of the lowest-level digital beam portions LDBP of each of the respective sixty-four antenna elements 102 in the respective proper subset 252. Additionally, relative time-delays between each of the second iteration level digital beam portions DBP2 in a given proper subset 252 can be applied, and the third iteration level digital beam portion DBP3 associated with a given proper subset 252 can be assigned an associated time-delay relative to the third iteration level digital beam portions DBP3 associated with other proper subsets 252, with the associated time-delay corresponding to a highest value time-delay associated with a given one of the antenna elements 102 in the respective proper subset 252.

Similarly, in the example of transmitting the wireless beam WB, in the third iteration level of the example of FIG. 6, a group of the digital beamforming processors 52 can each distribute four second iteration level digital beam portions DBP2 from a respective third iteration level digital beam portion DBP3 in a given one of the proper subsets 252, such that each of the four second iteration level digital beam portions DBP2 corresponds to a respective one of the proper subsets 202 in the example of FIG. 5. Additionally, each of the second iteration level digital beam portions DBP2 in a given one of the proper subsets 252 can be assigned a respective time-delay that is relative to each other for beam-steering the wireless beam WB to be transmitted from the array of antenna elements 102.

Figure 7:
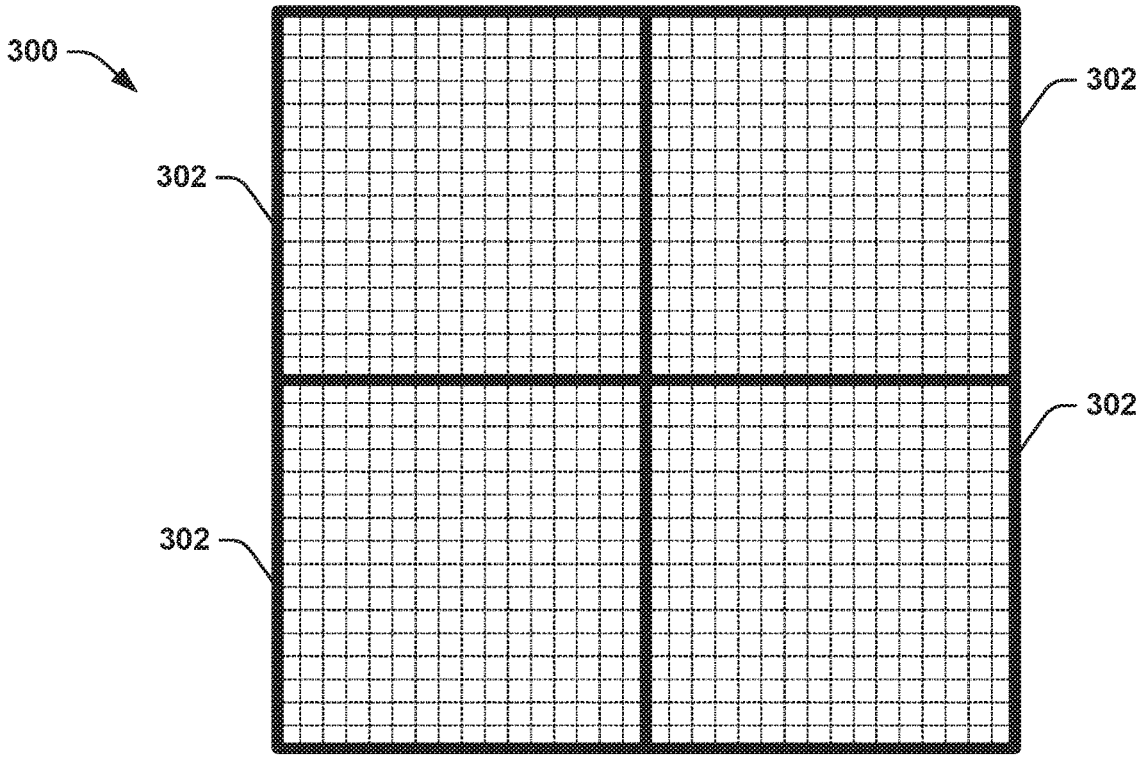
FIG. 7 illustrates yet another example diagram of antenna elements of an RF front-end.

The example of FIG. 7 demonstrates a diagram 300 of the array of antenna elements 102. As an example, the diagram 300 can correspond to a fourth iteration level of the iterative processing. In the example of FIG. 7, the antenna elements 102 are organized into proper subsets 302, where each proper subset 302 includes four of the proper subsets 252 in the example of FIG. 6. Therefore, each of the proper subsets 302 includes 256 antenna elements 102. Therefore, in the example of FIG. 7, the RF front-end includes four proper subsets 302 of antenna elements 102.

In the example of receiving the wireless beam WB, in the third iteration level of the example of FIG. 7, one of the digital beamforming processors 52 can be associated with each respective one of the proper subsets 302. For example, the digital beamforming processors 52 that are each associated with one of the proper subsets 302 can be a different digital beamforming processor 52 than is associated with a proper subset of any other iteration level. Therefore, some of the digital beamforming processors 52 can each transmit a respective third iteration level digital beam portion DBP3 to another one of the digital beamforming processors 52 for the other one of the digital beamforming processors 52 to add the third iteration level digital beam portions DBP3 to generate a fourth iteration level digital beam portion DBP4 that is a sum of the third iteration level digital beam portions DBP3 provided to it. For example, because the fourth iteration level in the example of FIG. 7 demonstrates that each of the proper subsets 302 includes four of the proper subsets 252 in the example of FIG. 6, four digital beamforming processors 52 associated with a respective four of the proper subsets 252 can provide the respective third iteration level digital beam portions DBP3 to a fifth digital beamforming processor 52, and the fifth digital beamforming processor 52 can add the four third iteration level digital beam portions DBP3 to generate the fourth iteration level digital beam portion DBP4. Therefore, the fourth iteration level digital beam portion DBP4 can correspond to a sum of the lowest-level digital beam portions LDBP of each of the respective 256 antenna elements 102 in the respective proper subset 302. Additionally, relative time-delays between each of the third iteration level digital beam portions DBP3 in a given proper subset 302 can be applied, and the fourth iteration level digital beam portions DBP4 associated with a given proper subset 302 can be assigned an associated time-delay relative to the other fourth iteration level digital beam portions associated with the respective proper subsets 302, with the associated time-delay corresponding to a highest value time-delay associated with a given one of the antenna elements 102 in the respective proper subset 302.

Similarly, in the example of transmitting the wireless beam WB, in the fourth iteration level of the example of FIG. 7, a group of the digital beamforming processors 52 can each distribute four third iteration level digital beam portions DBP3 from a respective fourth iteration level digital beam portion DBP4 in a given one of the proper subsets 302, such that each of the four third iteration level digital beam portions DBP3 corresponds to a respective one of the proper subsets 252 in the example of FIG. 6. Additionally, each of the third iteration level digital beam portions DBP3 in a given one of the proper subsets 302 can be assigned a respective time-delay that is relative to each other for beam-steering the wireless beam WB to be transmitted from the array of antenna elements 102.

The iterative processing of the examples of FIGS. 3-7 can also include a highest level of iterative processing that includes all of the antenna elements 102 in the array. For example, in the example of receiving the wireless beam WB, the four digital beam portions DBP4 can be added to generate a digital beam portion DBP5 that corresponds to the sum of the lowest-level digital beam portions LDBP of all of the antenna elements 102 of the array. The digital beam portion DBP5 can thus correspond to the digital beam DB that can be provided to the digital beamforming system 16 to process and demodulate the digital beam DB to determine the data therein. In the example of transmitting the wireless beam WB, the four digital beam portions DBP4 can be distributed from the digital beam portion DBP5 and further iteratively distributed, as described in the examples of FIGS. 3-7 in reverse order to transmit the wireless beam WB based on the beamforming characteristics defined by the digital beamforming system 16 in generating the digital beam DB.

By shifting the burden of processing of the digital beam DB to the digital beamforming processors 52, instead of providing all of the processing of the digital beam DB at the digital beamforming system 16, the operation of the digital beamforming processors 52 provides a more efficient manner of processing the digital beam DB for transmission or receipt of the wireless beam WB. Accordingly, the processing of the digital beam DB by the digital beamforming processors 52 can substantially mitigate a potential processing bottleneck that is provided by the digital beamforming system 16. Additionally, by implementing the digital beamforming processors 52 as distributed across the RF front-end 12 with respect to the antenna elements 102, the phased-array antenna system 10 can have a significantly more efficient design by mitigating the interconnects between the digital beamforming system 16 and each of the individual antenna elements 102, as is provided in typical phased-array antenna systems.

Furthermore, the digital beamforming system 16 can communicate with one or more of the digital beamforming processors 52, such as associated with processing some of the higher iteration levels of the iterative processing. Thus, the digital beamforming system 16 can effectively monitor the iterative processing to determine sufficiency of a given digital beam DB (e.g., in response to receiving a wireless beam WB). For example, the digital beamforming system 16 can monitor a higher iteration level (e.g., at one or more of the respective digital beamforming processors 52) to determine if a given received wireless beam WB satisfies certain predetermined criteria. If the digital beam DB is not determined to satisfy the predetermined criteria at the given iteration level, and is therefore not a signal of interest to the phased-array antenna system 10, then the digital beamforming system 16 can cease processing of the digital beam DB, such as to conserve bandwidth and/or processing overhead of the digital beamforming processors 52.

As another example, at the higher levels of iteration, the digital beamforming processors 52 may implement the time-delays with larger resolution (e.g., less precision), which can be implemented at a lower digital sample rate. As a result, each physical delay element can implement a larger delay with fewer memory elements. At the lower iteration levels, the sample rate may be increased, or possibly only the lowest iteration level will have a higher sample rate, to achieve a fine resolution for the time-delay. As yet another example, instead of increasing the sample rate at that lowest iteration level, the lowest iteration could use a phase shift (e.g., as an approximation for a time-delay for a narrow frequency band). Accordingly, the beamforming system could implement hybrid phase-shifts (e.g., at lowest iteration level) and time-delays (e.g., at higher iteration levels) to efficiently implement the beam-steering. Accordingly, for these reasons described herein, the phased-array antenna system 10 can provide for a more efficient and effective design for beamforming of a wireless beam WB.

Figure 8:
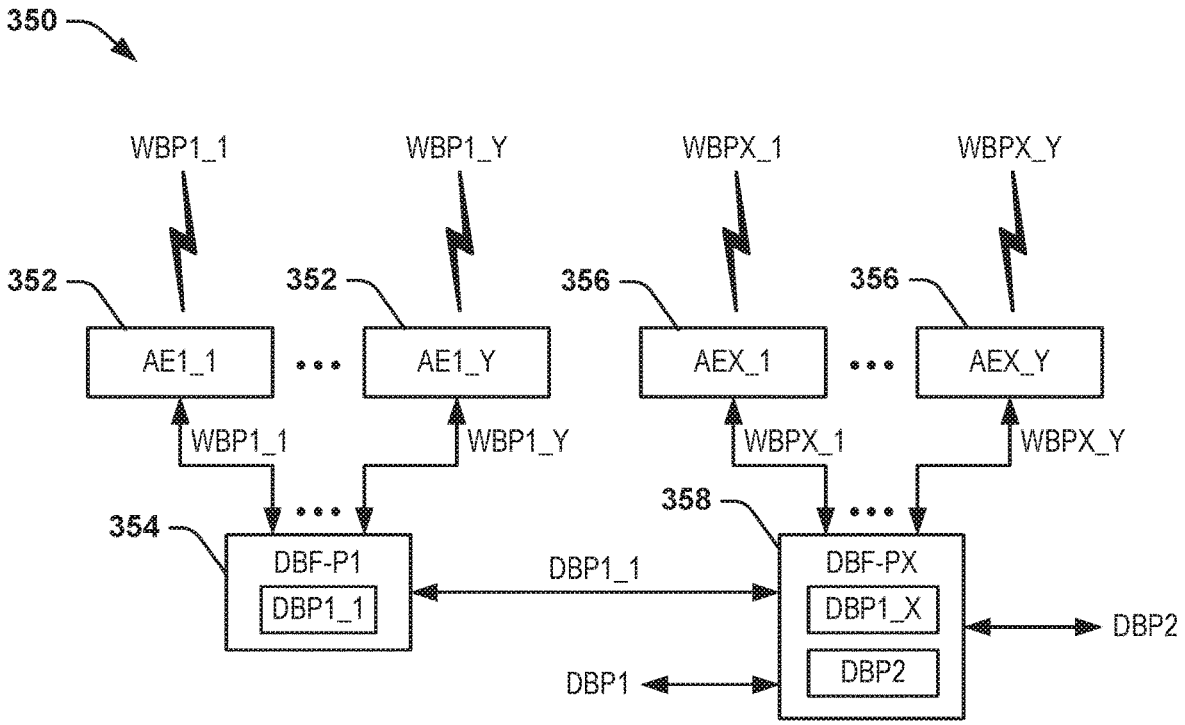
FIG. 8 illustrates an example diagram of iterative beamforming processing.

FIG. 8 illustrates an example diagram 350 of iterative beamforming processing. The diagram 350 demonstrates a first proper subset of antenna elements 352 and a first digital beamforming processor 354, as well as a second proper subset of antenna elements 356 and a second digital beamforming processor 358. The antenna elements 352 and 356 can correspond to the antenna elements 14 and 102 in the respective examples of FIGS. 1 and 3-7 and the digital beamforming processors 354 and 358 can correspond to the digital beamforming processors 52 in the example of FIG. 2. Therefore, reference is to be made to the examples of FIGS. 1-7 in the following description of the example of FIG. 8.

In the example of FIG. 8, the digital beamforming processors 354 and 358 can correspond to two of a plurality X of digital beamforming processors that are distributed as an array across the array of antenna elements (e.g., the antenna elements 102), where X is a positive integer greater than one. Thus, the digital beamforming processor 354 is designated "DBF-P1" and the digital beamforming processor 358 is designated "DBF-PX". Similar to as described previously, each of digital beamforming processors 354 and 358 are communicatively coupled to the respective proper subsets of antenna elements 352 and 356. Therefore, each of the digital beamforming processors 354 and 358 is associated with each of the plurality Y of antenna elements 352 and 356, respectively, where Y is a positive integer greater than one. Therefore, the antenna elements 352 are designated "AE1_1" through "AE1_Y" and the antenna elements 352 are designated "AEX_1" through "AEX_Y" to designate association with the respective digital beamforming processors 354 and 358 and a quantity in each of the respective proper subsets. In the examples of FIGS. 3-7, X is equal to 256 and Y is equal to four. For example, the proper subset of antenna elements 352 can be most proximal to the digital beamforming processor 354 and the proper subset of antenna elements 356 can be most proximal to the digital beamforming processor 358 to provide for shorter conductive interconnects between the antenna elements and the digital beamforming processors across the RF front-end 12.

In the example of FIG. 8, each of the antenna elements 352 and 356 is configured to propagate a wireless beam portion WBP, designated as "WBP1_1" through "WBP1_Y" and "WBPX_1" through "WBPX_Y" to correspond to the respective antenna elements 352 and 356, that collectively correspond to the wireless beam WB. As an example, for a received wireless beam WB, each of the antenna elements 14 can provide the respective wireless beam portion WBP1_1 through WBP1_Y and WBPX_1 through WBPX_Y that is associated with the respective wireless beam WB to the digital beamforming processors 354 and 358, respectively. The wireless beam portions WBP1_1 through WBP1_Y and WBPX_1 through WBPX_Y can each be digitized, such as by the digital beamforming processors 354 and 358 (e.g., via the ADCs 20 as part of the function of the digital beamforming processors 354 and 358) to generate respective lowest-level digital beam portions LDBP that are digital equivalents of the wireless beam portions WBP1_1 through WBP1_Y and WBPX_1 through WBPX_Y. Alternatively, the digitization can be performed by separate components with respect the digital beamforming processors 354 and 358. The digital beamforming processor 354 can thus add corresponding lowest-level digital beam portions in the first iteration level 54 to generate a respective first iteration level digital beam portion DBP1_1 and the digital beamforming processor 358 can thus add corresponding lowest-level digital beam portions in the first iteration level 54 to generate a respective first iteration level digital beam portion DBP1_X. The first iteration level digital beam portion DBP1_1 can correspond to a sum of the lowest-level digital beam portions LDBP associated with the wireless beam portions WBP1_1 through WBP1_Y and the first iteration level digital beam portion DBP1_X can correspond to a sum of the lowest-level digital beam portions LDBP associated with the wireless beam portions WBPX_1 through WBPX_Y. Additionally, the relative time-delays of the wireless beam portions WBP1_1 through WBP1_Y and WBPX_1 through WBPX_Y can be applied for received/transmitted wireless beam portions WBP1_1 through WBP1_Y and WBPX_1 through WBPX_Y, as described previously.

In the example of FIG. 8, the digital beamforming processors 354 and 358 can be communicatively coupled to each other. For example, the digital beamforming processors 354 and 358 can be most proximal (e.g., adjacent) with respect to each other in the array of digital beamforming processors associated with the array of antenna elements, such that the proper subset of the antenna elements 352 can be adjacent to the proper subset of the antenna elements 356. As an example, each of the digital beamforming processors 52 in the array of digital beamforming processors can be most proximal (e.g., adjacent) to at least two other digital beamforming processors 52 corresponding to adjacent proper subsets of antenna arrays, and can have conductive coupling to one or more (e.g. up to four) most proximal (e.g., adjacent) digital beamforming processors 52 (e.g., corresponding to a 2×2 array of digital beamforming processors 52). Therefore, proximal digital beamforming processors 52 can each be communicatively coupled to each other to substantially mitigate interconnect lengths for more efficiently passing the beamforming information between the digital beamforming processors 52.

As a result of the conductive coupling of the most proximal digital beamforming processors 52 with respect to each other, the digital beamforming processors 52 are configured to provide digital beam portions to most proximal digital beamforming processors 52 for a most proximal digital beamforming processor 52 to perform a next iteration level processing of the iterative processing. Additionally, some digital beamforming processors 52 can be communicatively coupled to another digital beamforming processor 52 to pass a processed digital beam portion (e.g., distributed or added) to the other digital beamforming processor 52 to perform a next iteration level processing. In the example of FIG. 8, the digital beamforming processor 354 is demonstrated as passing a signal "DBP1_1" corresponding to the first iteration level digital beam portion DBP1_1 to the digital beamforming processor 358. Therefore, along with the first iteration level digital beam portion DBP1_X and other first iteration level digital beam portions DBP1 from other digital beamforming processors (not shown in the example of FIG. 8), the digital beamforming processor 358 can process a second iteration level digital beam portion DBP2. For example, the digital beamforming processor 358 can generate the second iteration level digital beam portion DBP2 based on the first iteration level digital beam portions DBP1_1, DBP1_X, and DBP1, and can provide the second iteration level digital beam portion DBP2 to another digital beamforming processor for generation of a third iteration level digital beam portion (e.g., along with other second iteration level digital beam portions) for a received wireless beam WB. As another example, the digital beamforming processor 358 can receive the second iteration level digital beam portion DBP2 from another digital beamforming processor, such that the digital beamforming processor 358 can distribute the first iteration level digital beam portions DBP1_1, DBP1_X, and DBP1 from the second iteration level digital beam portion DBP2 for transmitting the wireless beam WB.

Figure 9:
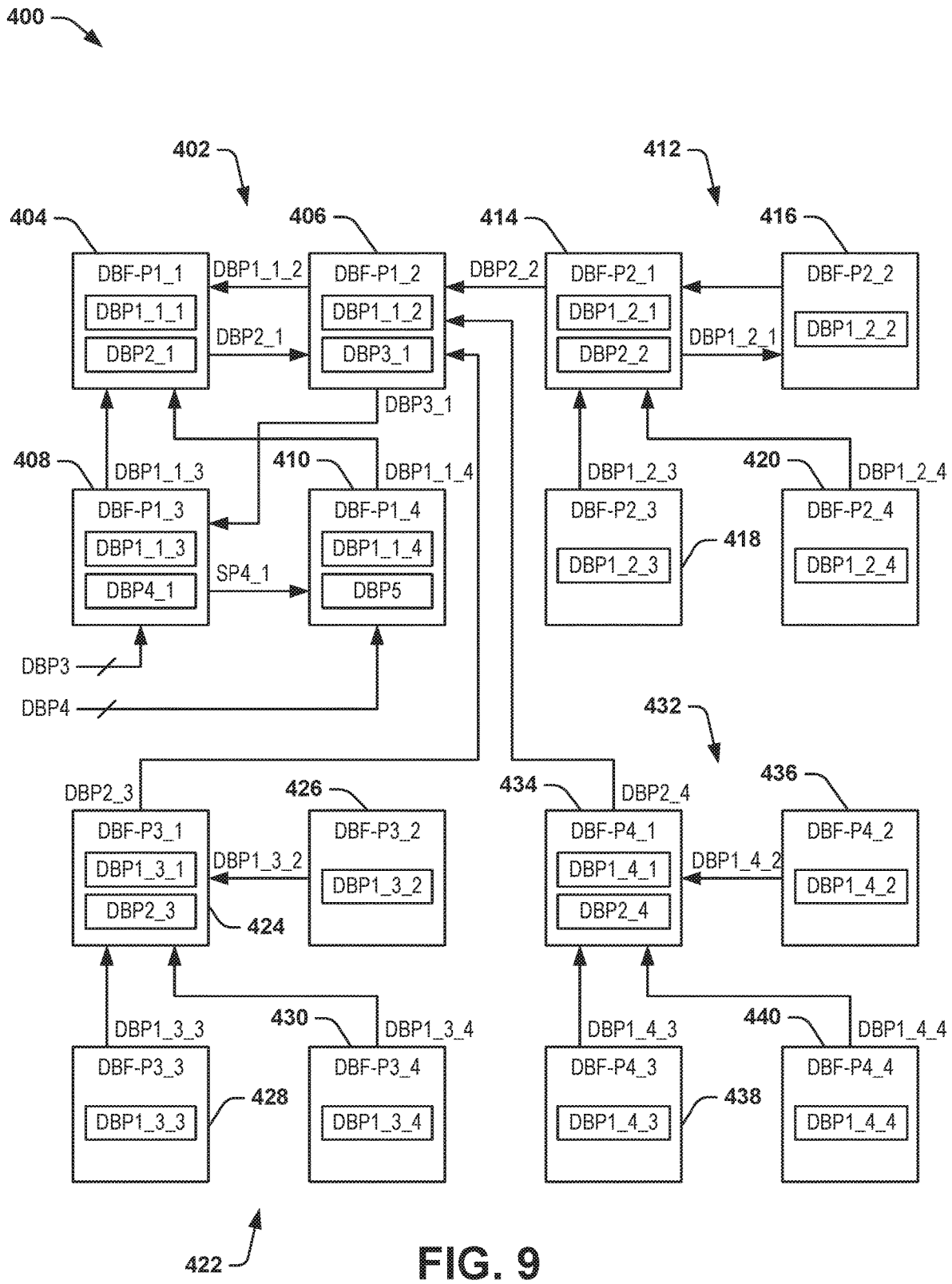
FIG. 9 illustrates another example diagram of iterative beamforming processing.

FIG. 9 illustrates an example diagram 400 of iterative beamforming processing. The diagram 400 demonstrates sixteen digital beamforming processors arranged in an approximate array. The diagram 400 includes a first set of digital beamforming processors at 402, with the first set of digital beamforming processors 402 including a digital beamforming processor 404, a digital beamforming processor 406, a digital beamforming processor 408, and a digital beamforming processor 410. The diagram 400 also includes a second set of digital beamforming processors at 412, with the second set of digital beamforming processors 412 including a digital beamforming processor 414, a digital beamforming processor 416, a digital beamforming processor 418, and a digital beamforming processor 420. The diagram 400 also includes a third set of digital beamforming processors at 422, with the third set of digital beamforming processors 422 including a digital beamforming processor 424, a digital beamforming processor 426, a digital beamforming processor 428, and a digital beamforming processor 430. The diagram 400 further includes a fourth set of digital beamforming processors at 432, with the fourth set of digital beamforming processors 432 including a digital beamforming processor 434, a digital beamforming processor 436, a digital beamforming processor 438, and a digital beamforming processor 440. The digital beamforming processors in the diagram 400 can correspond to the digital beamforming processors 52 in the example of FIG. 2. Therefore, reference is to be made to the examples of FIGS. 1-8 in the following description of the example of FIG. 9. Additionally, the iterative processing demonstrated in the example of FIG. 9 is provided by example as beamforming for a received wireless beam. However, it is to be understood that the direction of data flow can be reversed for the example of beamforming for a transmitted wireless beam.

The digital beamforming processors in the diagram 400 are demonstrated as having a designation "DBF-PN_M", where "N" corresponds to which of the sets of digital beamforming processors 402, 412, 422, and 432 that the digital beamforming processor belongs and "M" corresponds to an individual designation within the respective set of digital beamforming processors. Each of the digital beamforming processors in the diagram 400 can be associated with a respective proper subset of antenna elements. For example, each of the digital beamforming processors in the diagram 400 can be communicatively coupled to four separate antenna elements 102 of the array of antenna elements, such that each of the digital beamforming processors can be associated with one of the proper subsets 152 in the example of FIG. 4. Similar to as described previously, the digital beamforming processors in the diagram 400 can be arranged in an array, with each of the sets of digital beamforming processors 402, 412, 422, and 432 being associated with corresponding adjacent proper subsets 152 of the antenna elements 102. Therefore, each of the digital beamforming processors is configured to implement a first iteration level of the iterative processing, corresponding to processing the lowest-level digital beam portions LDBP that respectively correspond to the wireless beam portions WBP of each of the respective antenna elements in the given proper subset 152. Therefore, each of the digital beamforming processors is demonstrated in the example of FIG. 9 as processing a respective first iteration level digital beam portion designated "DBP1_N_M", where the "1" corresponds to the first iteration level.

In the example of FIG. 9, the digital beamforming processor 404 generates a first iteration level digital beam portion DBP1_1_1, the digital beamforming processor 406 generates a first iteration level digital beam portion DBP1_1_2, the digital beamforming processor 408 generates a first iteration level digital beam portion DBP1_1_3, and the digital beamforming processor 410 generates a first iteration level digital beam portion DBP1_1_4. Similarly, the digital beamforming processor 414 generates a first iteration level digital beam portion DBP1_2_1, the digital beamforming processor 416 generates a first iteration level digital beam portion DBP1_2_2, the digital beamforming processor 418 generates a first iteration level digital beam portion DBP1_2_3, and the digital beamforming processor 420 generates a first iteration level digital beam portion DBP1_2_4. Similarly, the digital beamforming processor 424 generates a first iteration level digital beam portion DBP1_3_1, the digital beamforming processor 426 generates a first iteration level digital beam portion DBP1_3_2, the digital beamforming processor 428 generates a first iteration level digital beam portion DBP1_3_3, and the digital beamforming processor 430 generates a first iteration level digital beam portion DBP1_3_4. Similarly, the digital beamforming processor 434 generates a first iteration level digital beam portion DBP1_4_1, the digital beamforming processor 436 generates a first iteration level digital beam portion DBP1_4_2, the digital beamforming processor 438 generates a first iteration level digital beam portion DBP1_4_3, and the digital beamforming processor 440 generates a first iteration level digital beam portion DBP1_4_4. Each of the respective first iteration level digital beam portions DBP1 can corresponds to sums of the lowest-level digital beam portions LDBP associated with each of the antenna elements of a respective proper subset (e.g., quantity four) of the antenna elements. Additionally, similar to as described previously, relative time-delays between each of the lowest-level digital beam portions LDBP can be applied, and each of the first iteration level digital beam portions DBP1 can be assigned an associated time-delay relative to the other first iteration level digital beam portions DBP1.

In a second iteration level corresponding to a next iteration level of the iterative processing, some of the first iteration level digital beam portions are added together to generate second iteration level digital beam portions. In the example of FIG. 9, the digital beamforming processors 406, 408, and 410 are communicatively coupled to the digital beamforming processor 404. Thus, the first iteration level digital beam portions DBP1_1_2, DBP1_1_3, and DBP1_1_4 are provided from the digital beamforming processors 406, 408, and 410, respectively, to the digital beamforming processor 404. Therefore, the digital beamforming processor 404 is configured to generate a second iteration level digital beam portion DBP2_1 corresponding to a sum of the first iteration level digital beam portions DBP1_1_1, DBP1_1_2, DBP1_1_3, and DBP1_1_4. Similarly, the digital beamforming processors 416, 418, and 420 are communicatively coupled to the digital beamforming processor 414. Thus, the first iteration level digital beam portions DBP1_2_2, DBP1_2_3, and DBP1_2_4 are provided from the digital beamforming processors 416, 418, and 420, respectively, to the digital beamforming processor 414. Therefore, the digital beamforming processor 414 is configured to generate a second iteration level digital beam portion DBP2_2 corresponding to a sum of the first iteration level digital beam portions DBP1_2_1, DBP1_2_2, DBP1_2_3, and DBP1_2_4. Similarly, the digital beamforming processors 426, 428, and 430 are communicatively coupled to the digital beamforming processor 424. Thus, the first iteration level digital beam portions DBP1_3_2, DBP1_3_3, and DBP1_3_4 are provided from the digital beamforming processors 426, 428, and 430, respectively, to the digital beamforming processor 424. Therefore, the digital beamforming processor 424 is configured to generate a second iteration level digital beam portion DBP2_3 corresponding to a sum of the first iteration level digital beam portions DBP1_3_1, DBP1_3_2, DBP1_3_3, and DBP1_3_4. Similarly, the digital beamforming processors 436, 438, and 440 are communicatively coupled to the digital beamforming processor 434. Thus, the first iteration level digital beam portions DBP1_4_2, DBP1_4_3, and DBP1_4_4 are provided from the digital beamforming processors 436, 438, and 440, respectively, to the digital beamforming processor 434. Therefore, the digital beamforming processor 434 is configured to generate a second iteration level digital beam portion DBP2_4 corresponding to a sum of the first iteration level digital beam portions DBP1_4_1, DBP1_4_2, DBP1_4_3, and DBP1_4_4. Additionally, similar to as described previously, relative time-delays between each of the first iteration level digital beam portions DBP1 can be applied, and each of the second iteration level digital beam portions DBP2 can be assigned an associated time-delay relative to the other second iteration level digital beam portions DBP2.

In a third iteration level corresponding to a next iteration level of the iterative processing, some of the second iteration level digital beam portions are added together to generate third iteration level digital beam portions. In the example of FIG. 9, the digital beamforming processors 404, 414, 424, and 434 are communicatively coupled to the digital beamforming processor 406. Thus, the second iteration level digital beam portions DBP2_1, DBP2_2, DBP2_3, and DBP2_4 are provided from the digital beamforming processors 404, 414, 424, and 434, respectively, to the digital beamforming processor 406. Therefore, the digital beamforming processor 406 is configured to generate a third iteration level digital beam portion DBP3_1 corresponding to a sum of the second iteration level digital beam portions DBP2_1, DBP2_2, DBP2_3, and DBP2_4. Additionally, similar to as described previously, relative time-delays between each of the second iteration level digital beam portions DBP2 can be applied, and each of the third iteration level digital beam portions DBP3 can be assigned an associated time-delay relative to the other third iteration level digital beam portions DBP3.

In a fourth iteration level corresponding to a next iteration level of the iterative processing, some of the third iteration level digital beam portions are added together to generate fourth iteration level digital beam portions. In the example of FIG. 9, the digital beamforming processor 406 is communicatively coupled to the digital beamforming processor 408, as are other (e.g., three other) digital beamforming processors not demonstrated in the example of FIG. 9. Thus, the third iteration level digital beam portion DBP3_1 is provided from the digital beamforming processor 406 to the digital beamforming processor 408, and other third iteration level digital beam portions DBP3 are provided from the other digital beamforming processors to the digital beamforming processor 408. Therefore, the digital beamforming processor 408 is configured to generate a fourth iteration level digital beam portion DBP4_1 corresponding to a sum of the third iteration level digital beam portion DBP3_1 and the other third iteration level digital beam portions DBP3. As an example, the fourth iteration level digital beam portion DBP4_1 can be one of four fourth iteration level digital beam portions, such as based on the arrangement of the RF front-end in the example of FIGS. 3-7. Additionally, similar to as described previously, relative time-delays between each of the third iteration level digital beam portions DBP3 can be applied, and each of the fourth iteration level digital beam portions DBP4 can be assigned an associated time-delay relative to the other fourth iteration level digital beam portions DBP4.

In a fifth iteration level corresponding to a next iteration level of the iterative processing, some of the fourth iteration level digital beam portions are added together to generate a fifth iteration level digital beam portion. In the example of FIG. 9, the digital beamforming processor 408 is communicatively coupled to the digital beamforming processor 410, as are other (e.g., three other) digital beamforming processors not demonstrated in the example of FIG. 9. Thus, the fourth iteration level digital beam portion DBP4_1 is provided from the digital beamforming processor 408 to the digital beamforming processor 410, and other fourth iteration level digital beam portions DBP4 are provided from the other digital beamforming processors to the digital beamforming processor 410. Therefore, the digital beamforming processor 410 is configured to generate a fifth iteration level digital beam portion DBP5 corresponding to a sum of the fourth iteration level digital beam portion DBP4_1 and the other fourth iteration level digital beam portions DBP4. As an example, the fifth iteration level digital beam portion DBP5 can be the highest iteration level digital beam portion, such as based on the arrangement of the RF front-end in the example of FIGS. 3-7, and can therefore represent a sum of all of the lowest-level digital beam portions LDBP of all of the respective antenna elements 102 in the examples of FIGS. 3-7. Additionally, similar to as described previously, relative time-delays between each of the fourth iteration level digital beam portions DBP4 can be applied to generate the fifth iteration level digital beam portion DBP5.

Therefore, the example of FIG. 9 demonstrates the interaction of the digital beamforming processors to perform the iterative processing of the digital beamforming. In the example of FIG. 9, none of the digital beamforming processors are configured to process more than two of the iteration levels, thereby distributing the processing of the beamforming among the digital beamforming processors. As a result, by shifting the burden of processing of the digital beam DB to the digital beamforming processors, instead of providing all of the processing of the digital beam DB at the digital beamforming system 16, the operation of the digital beamforming processors provides a more efficient manner of processing the digital beam DB for transmission or receipt of the wireless beam WB. Accordingly, the processing of the digital beam DB by the digital beamforming processors can substantially mitigate a potential processing bottleneck that is provided by the digital beamforming system 16. Additionally, by implementing the digital beamforming processors as distributed across the RF front-end 12 with respect to the antenna elements 102, the phased-array antenna system 10 can have a significantly more efficient design by mitigating the interconnects between the digital beamforming system 16 and each of the individual antenna elements 102, as is provided in typical phased-array antenna systems. Accordingly, for these reasons described herein, the phased-array antenna system 10 can provide for a more efficient and effective design for beamforming of a wireless beam WB.

Figure 10:
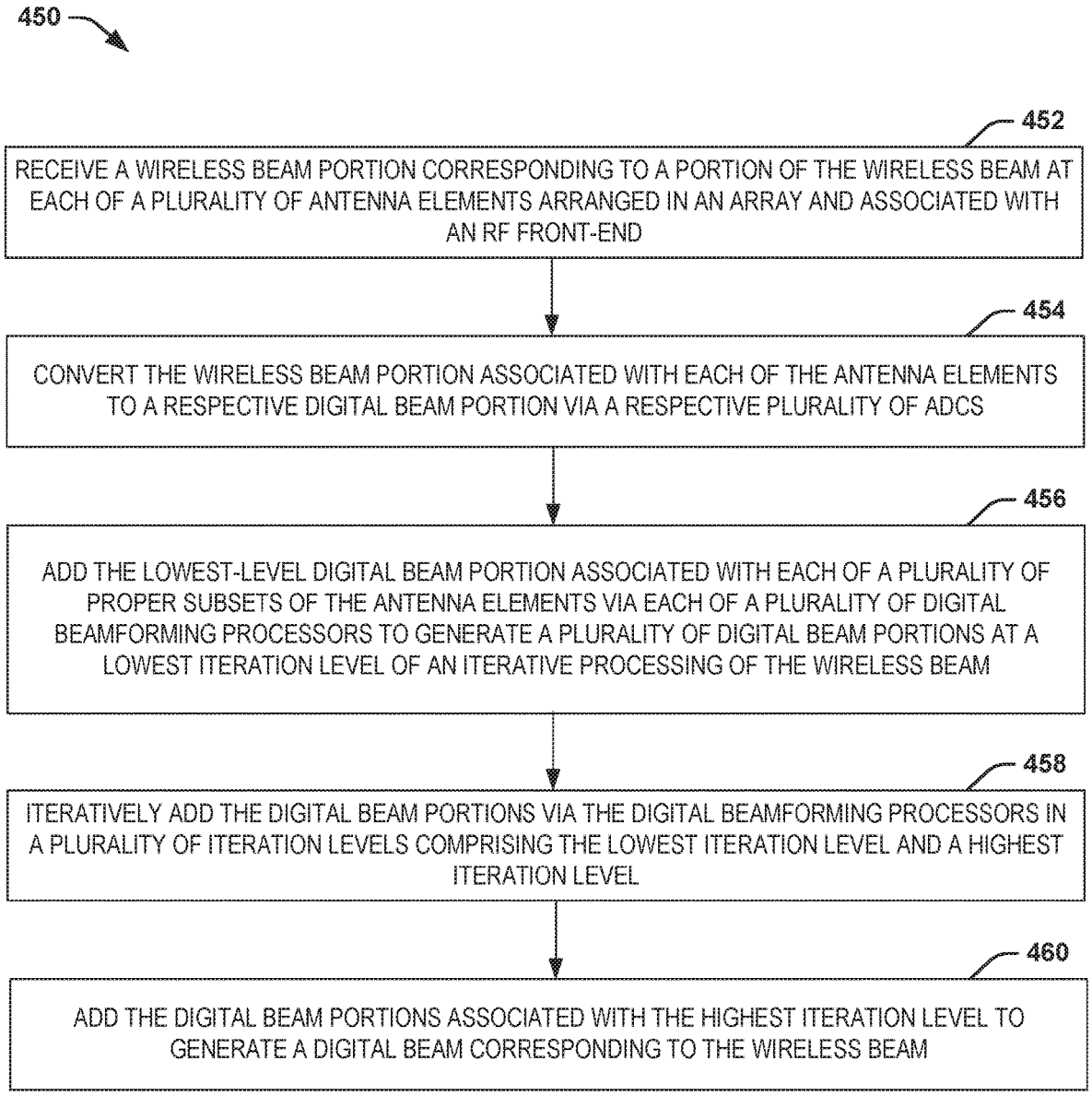
FIG. 10 illustrates an example of a method for receiving a wireless beam via a phased-array antenna system.
Figure 11:
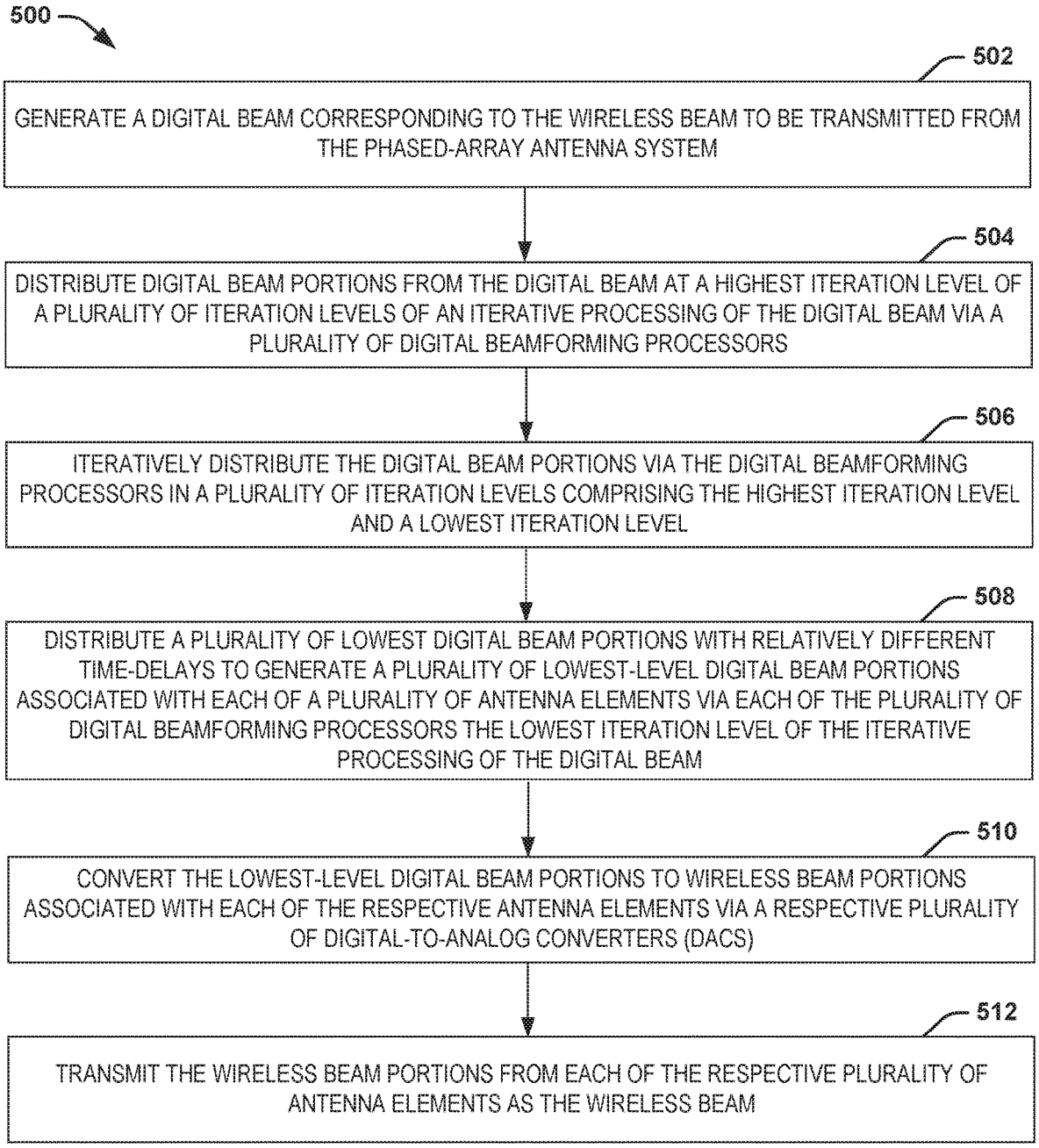
FIG. 11 illustrates an example of a method for transmitting a wireless beam via a phased-array antenna system.

In view of the foregoing structural and functional features described above, example methods will be better appreciated with reference to FIGS. 10 and 11. While, for purposes of simplicity of explanation, the methods are shown and described as executing serially, it is to be understood and appreciated that the methods are not limited by the illustrated order, as parts of the methods could occur in different orders and/or concurrently from that shown and described herein. Such methods can be executed by various components configured in an integrated circuit, processor, or a controller, for example.

FIG. 10 illustrates an example of a method 450 for receiving a wireless beam (e.g., the wireless beam WB) via a phased-array antenna system (e.g., the phased-array antenna system 10). At 452, a portion of the wireless beam is received at each of a plurality of antenna elements (e.g., the antenna elements 14) arranged in an array and associated with an RF front-end (e.g., the RF front-end 12). At 454, a wireless beam portion (e.g., the wireless beam portions WBP) associated with each of the antenna elements is converted to a respective lowest-level digital beam portion (e.g., the lowest-level digital beam portions LDBP) via a respective plurality of ADCs (e.g., the DACs/ADCs 20). At 456, the lowest-level digital beam portion associated with each of a plurality of proper subsets (e.g., the proper subsets 152) of the antenna elements is added via each of a plurality of digital beamforming processors (e.g., the digital beamforming processors 22) to generate a plurality of digital beam portions (e.g., the digital beam portions DBP) at a lowest iteration level of an iterative processing of the wireless beam. At 458, the digital beam portions are iteratively added via the digital beamforming processors in a plurality of iteration levels comprising the lowest iteration level and a highest iteration level. Each digital beam portion associated with a given iteration level includes a sum of lesser and relatively time-delayed digital beam portions from a next lower iteration level of the iterative processing. At 460, the digital beam portions associated with the highest iteration level are added to generate a digital beam (e.g., the digital beam DB) corresponding to the wireless beam.

FIG. 11 illustrates an example of a method 500 for transmitting a wireless beam (e.g., the wireless beam WB) via a phased-array antenna system (e.g., the phased-array antenna system 10). At 502, a digital beam (e.g., the digital beam DB) corresponding to the wireless beam to be transmitted from the phased-array antenna system is generated. At 504, digital beam portions (e.g., the digital beam portions DBP) are distributed from the digital beam at a highest iteration level of a plurality of iteration levels of an iterative processing of the digital beam via a plurality of digital beamforming processors (e.g., the digital beamforming processors 22). At 506, the digital beam portions are iteratively distributed via the digital beamforming processors in a plurality of iteration levels comprising the highest iteration level and a lowest iteration level. each digital beam portion associated with a given iteration level is distributed from the given iteration level as a plurality of lesser digital beam portions with relatively different time-delays to a next lower iteration level of the iterative processing, with the lesser digital beam portions being equal in aggregate to the respective digital beam portion. At 508, a plurality of digital beam portions are distributed to generate a plurality of lowest-level digital beam portions (e.g., the lowest-level digital beam portions LDBP) associated with each of a plurality of antenna elements (e.g., the antenna elements 14) via each of the plurality of digital beamforming processors the lowest iteration level of the iterative processing of the digital beam. At 510, the lowest-level digital beam portions are converted to wireless beam portions (e.g., the wireless beam portions WB) associated with each of the respective antenna elements via a respective plurality of DACs (e.g., the DACs/ADCs 20). At 512, the wireless beam portions are transmitted from each of the respective plurality of antenna elements as the wireless beam.

What has been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. A phased-array antenna system comprising:

a radio frequency (RF) front-end configured to transmit or receive a wireless beam, the RF front-end comprising a plurality of antenna elements arranged in an array;

a digital beamforming system configured to generate a digital beam corresponding to the wireless beam; and a digital signal conditioner system comprising a plurality of digital beamforming processors, the plurality of digital beamforming processors being collectively configured to iteratively process digital beam portions of the digital beam in a plurality of iteration levels comprising a lowest iteration level associated with lowest-level digital beam portions corresponding to respective wireless beam portions at each of the respective antenna elements and a highest iteration level associated with the digital beam, wherein each digital beam portion associated with a given iteration level comprises a plurality of digital beam portions from a next lower iteration level.

2. The system of claim 1, wherein each of the plurality of antenna elements is configured to propagate a wireless beam portion at a respective time delay and amplitude.

3. The system of claim 1, wherein each of the plurality of digital beamforming processors is associated with a proper subset of the plurality of antenna elements.

4. The system of claim 3, wherein each digital beamforming processor is configured to process a sum of the lowest-level digital beam portions associated with the respective proper subset of the plurality of antenna elements at the lowest iteration level of the iterative processing.

5. The system of claim 3, wherein a set of the plurality of digital beamforming processors is associated with respective adjacent proper subsets of the antenna elements, such that a respective one of the set of digital beamforming processors is communicatively coupled to each remaining digital beamforming processor of the set of digital beamforming processors to process the lowest-level digital beam portions of each digital beamforming processor of the set of digital beamforming processors as a first iteration level digital beam portion, wherein a second one of the set of digital beamforming processors is communicatively coupled to another digital beamforming processor outside of the set of digital beamforming processors, such that the other digital beamforming processor is configured to process a second iteration level digital beam portion in the second iteration level based on the first iteration level digital beam portion and at least one other first iteration level digital beam portion associated with another set of the plurality of digital beamforming processors.

6. The system of claim 1, wherein each digital beam portion associated with a given iteration level comprises a sum of lesser and relatively time-delayed digital beam portions from a next lower iteration level.

7. The system of claim 1, wherein each digital beam portion is associated with a plurality of lowest-level digital beam portions corresponding to a subset of the plurality of antenna elements, such that the digital beam portion associated with the given iteration level comprises a subset of the plurality of antenna elements that is greater than the subset of the plurality of antenna elements associated with the next lower iteration level of the iterative processing.

8. The system of claim 1, wherein each digital beam portion in each given iteration level is associated with a sum of the portions of wireless beam of a contiguous group of the antenna elements, wherein the contiguous group of the antenna elements increases in quantity from the lowest iteration level to the highest iteration level, wherein a first digital beamforming processor is configured to process the sum of the lowest-level digital beam portions associated with a respective contiguous group of the antenna elements in a given iteration level of the iterative processing, wherein a second digital beamforming processor is configured to process a sum of the lowest-level digital beam portions associated with the respective contiguous group of antenna elements and at least one adjacent and equal-sized contiguous group of the antenna elements in a next higher iteration level of the iterative processing.

9. The system of claim 1, wherein each of a proper subset of the digital beamforming processors is configured to process the digital beam portion associated with the lowest iteration level and to process the digital beam portion associated with a higher iteration level in the plurality of iteration levels.

10. The system of claim 1, wherein the digital signal conditioner system comprises a plurality of frequency channels that are each associated with a separate frequency, wherein each of the frequency channels is coupled to each of the plurality of digital beamforming processors.

11. A method for receiving a wireless beam via a phased-array antenna system, the method comprising:

receiving a wireless beam portion corresponding to a portion of the wireless beam at each of a plurality of antenna elements arranged in an array and associated with a radio frequency (RF) front-end;

converting the wireless beam portion associated with each of the antenna elements to a respective lowest-level digital beam portion via a respective plurality of analog-to-digital converters (ADCs); and iteratively adding digital beam portions in a plurality of iteration levels from a lowest iteration level associated with the lowest-level digital beam portion associated with each of the respective antenna elements to a digital beam at a highest iteration level to generate a digital beam corresponding to the wireless beam via digital beamforming processors.

12. The method of claim 11, wherein iteratively adding the digital beam portions comprises iteratively adding the digital beam portions such that each digital beam portion associated with a given iteration level comprises a sum of lesser and relatively time-delayed digital beam portions from a next lower iteration level of the iterative processing.

13. The method of claim 11, wherein each digital beam portion is associated with a plurality of lowest-level digital beam portions corresponding to a subset of the plurality of antenna elements, wherein iteratively adding the digital beam portions comprises iteratively adding a plurality of digital beam portions associated with a respective plurality of subsets of the plurality of antenna elements that are each associated with a next lower iteration level to generate a greater digital beam portion associated with a subset of the plurality of antenna elements that comprises the plurality of subsets of the antenna elements at a next higher iteration level of the iterative processing, wherein the subset of the plurality of antenna elements comprises a contiguous subset of the antenna elements, and wherein iteratively adding the plurality of digital beam portions comprises iteratively adding the plurality of digital beam portions associated with a respective plurality of subsets of the plurality of antenna elements that are adjacent with respect to each other.

14. The method of claim 11, wherein iteratively adding the digital beam portions comprises assigning a time-delay value to each of the plurality of digital beam portions to time-align each of the plurality of digital beam portions to form a digital beam portion of a next higher iteration level, the digital beam portion of the next higher iteration level comprising the plurality of digital beam portions.

15. The method of claim 11, wherein each of first set and a second set of the plurality of digital beamforming processors is associated with respective adjacent proper subsets of the antenna elements, wherein iteratively adding the digital beam portions comprises:

receiving at a respective one of the first set of digital beamforming processors the lowest-level digital beam portions of each remaining digital beamforming processor of the first set of digital beamforming processors;

adding the lowest-level digital beam portion associated with each digital beamforming processor of the first set of digital beamforming processors as a first iteration level digital beam portion;

providing the first iteration level digital beam portion from the respective one of the first set of digital beamforming processors to a digital beamforming processor of the second set of digital beamforming processors; and adding the first iteration level digital beam portion and at least one other first iteration level digital beam portion associated with at least the second set of the plurality of digital beamforming processors, respectively, at the digital beamforming processor of the second set of digital beamforming processors to generate a second iteration level digital beam portion.

16. A method for transmitting a wireless beam via a phased-array antenna system, the method comprising:

generating a digital beam corresponding to the wireless beam to be transmitted from the phased-array antenna system;

distributing digital beam portions from the digital beam at a highest iteration level of a plurality of iteration levels of an iterative processing of the digital beam via a plurality of digital beamforming processors;

iteratively distributing digital beam portions via digital beamforming processors in a plurality of iteration levels from a highest iteration level associated with the digital beam to a lowest iteration level comprising a plurality of lowest-level digital beam portions that are each associated with a respective plurality of antenna elements;

converting the lowest-level digital beam portions to wireless beam portions associated with each of the respective plurality of antenna elements via a respective plurality of digital-to-analog converters (DACs); and transmitting the wireless beam portions from each of the respective plurality of antenna elements as the wireless beam.

17. The method of claim 16, wherein iteratively distributing the digital beam portions comprises iteratively distributing the digital beam portions such that each digital beam portion associated with a given iteration level is distributed from the given iteration level as a plurality of lesser digital beam portions with relatively different time-delays to a next lower iteration level of the iterative processing, with the lesser digital beam portions being equal in aggregate to the respective digital beam portion.

18. The method of claim 16, wherein each digital beam portion is associated with the plurality of lowest-level digital beam portions corresponding to a subset of the plurality of antenna elements, wherein iteratively distributing the digital beam portions comprises iteratively distributing a digital beam portion associated with a respective subset of the plurality of antenna elements at a given iteration level to generate a plurality of lesser digital beam portions associated with a plurality of subsets of the plurality of antenna elements that form the respective subset of the antenna elements at a next lower iteration level of the iterative processing, wherein the respective subset of the plurality of antenna elements comprises a contiguous subset of the antenna elements, and wherein iteratively distributing the plurality of digital beam portions comprises iteratively distributing the plurality of digital beam portions associated with the respective plurality of subsets of the plurality of antenna elements that are adjacent with respect to each other.

19. The method of claim 16, wherein iteratively distributing the digital beam portions comprises assigning a time-delay to each of a plurality of digital beam portions distributed from a digital beam portion of a higher iteration level in the plurality of iteration levels, the time-delay of each of the plurality of digital beam portions being relative to the time-delay of the other digital beam portions distributed from the digital beam portion of the higher iteration level.

20. The method of claim 16, wherein sets of the plurality of digital beamforming processors are each associated with respective adjacent proper subsets of the antenna elements, wherein iteratively distributing the digital beam portions comprises:

providing a second iteration level digital beam portion to a digital beamforming processor associated with a first set of the sets of digital beamforming processors;

distributing a plurality of first iteration level digital beam portions from the second iteration level summation at the digital beamforming processor associated with the first set of digital beamforming processors;

providing each of the plurality of first level digital beam portions to a respective digital beamforming processor associated with a respective plurality of sets of the digital beamforming processors;

distributing a plurality of lowest-level digital beam portions from the first iteration level summation at the digital beamforming processor associated with the first set of digital beamforming processors; and providing each of the plurality of lowest-level digital beam portions from the respective lowest-level digital beam portion of each of the digital beamforming processors in each of the respective sets of the digital beamforming processors.

* * * * *